US007950757B2

(12) United States Patent
Kumagai

(10) Patent No.: US 7,950,757 B2
(45) Date of Patent: May 31, 2011

(54) IMAGE RECORDING APPARATUS

(75) Inventor: Yukitaka Kumagai, Iruma (JP)

(73) Assignee: Olympus Corporation, Tokyo (JP)

( * ) Notice: Subject to any disclaimer, the term of this patent is extended or adjusted under 35 U.S.C. 154(b) by 30 days.

(21) Appl. No.: 12/476,443

(22) Filed: Jun. 2, 2009

(65) Prior Publication Data

US 2009/0237477 A1 Sep. 24, 2009

Related U.S. Application Data

(62) Division of application No. 11/481,114, filed on Jul. 5, 2006, now abandoned.

(30) Foreign Application Priority Data

Jul. 5, 2005 (JP) ..... 2005-196388

(51) Int. Cl.
*B41J 23/00* (2006.01)

(52) U.S. Cl. ..... 347/8; 347/101; 347/104

(58) Field of Classification Search ..... 347/8, 9, 347/37, 5, 101, 104
See application file for complete search history.

(56) References Cited

U.S. PATENT DOCUMENTS 5,274,399 A 12/1993 Uchida et al.
6,042,217 A 3/2000 Jones
7,152,971 B2 12/2006 Kumagai et al.
2005/0093921 A1 5/2005 Kumagai
2009/0237477 A1 9/2009 Kumagai

FOREIGN PATENT DOCUMENTS

JP 3-243356 A 10/1991
JP 2816217 B2 8/1998
JP 2005-138371 A 6/2005
JP 2005-170547 A 6/2005

OTHER PUBLICATIONS

U.S. Appl. No. 12/476,498; First Named Inventor: Yukitaka Kumagai; Title: "Image Recording Apparatus"; Filed: Jun. 2, 2009.
Japanese Office Action dated Jul. 27, 2010 and English translation thereof, issued in counterpart Japanese Application No. 2005-196388.

*Primary Examiner* — Lam S Nguyen
(74) *Attorney, Agent, or Firm* — Holtz, Holtz, Goodman & Chick, PC

(57) ABSTRACT

In an image recording apparatus, there are oppositely arranged an image recording section capable of recording an image all over the recording width of a recording medium, and a platen section which holds the recording medium and which conveys the recording medium perpendicularly to a width direction of the recording medium. A platen driving unit can vary a space between the image recording section and the platen section. Positioning pins of a carriage are engaged with slide hooks to set a space between the platen driving unit and the image recording section.

13 Claims, 27 Drawing Sheets

IMAGE RECORDING APPARATUS

CROSS-REFERENCE TO RELATED APPLICATIONS

The present application is a Divisional application of U.S. application Ser. No. 11/481,114 filed Jul. 5, 2006, now abandoned which is based upon and claims the benefit of priority from prior Japanese Patent Application No. 2005-196388, filed Jul. 5, 2005, the entire contents of which are incorporated herein by reference.

BACKGROUND OF THE INVENTION

1. Field of the Invention

The present invention relates to an image recording apparatus which ejects ink onto a recording medium while conveying the recording medium by an endless belt to record an image thereon.

2. Description of the Related Art

In general, office automation equipment such as facsimiles, copiers and printers is in wide use. Among the office automation equipment, a recording apparatus of the type which uses cut sheets is equipped with a conveying mechanism. This conveying mechanism conveys the cut sheet from a paper feed section such as a cassette to an image recording section, and then conveys the cut sheet to a paper discharge section after image information is recorded in the image recording section.

In this case, the cut sheet is sucked or stuck to an endless belt and thus conveyed to the image recording section by the belt-type conveying mechanism. Ink is then ejected from an ink-jet-recording-type recording head, such that the image information is recorded.

Furthermore, the image information recorded on the cut sheet by the image recording section is the image information on an original read by a scanner which is converted into an electric signal. This electric signal causes the ink-jet-type recording head to be driven, and the ink is then ejected from the recording head in the process of passing the cut sheet under the recording head on the belt conveying section, thereby achieving the recording.

In the image recording apparatus having such a configuration, a gap between the endless belt forming the belt conveying section and the recording head is set to be very small, for example, 1 mm or less. Thus, when the cut sheet has caused a jam error for some reason during a recording operation of the image information, it is necessary to evacuate the belt conveying section downward and provide a work area (space) to remove the jammed cut sheet. Moreover, when a recovery operation of the recording head is performed, it is necessary to provide a work area (space) required to insert a maintenance section because the maintenance section is pressed against a nozzle under the recording head.

On the contrary, as disclosed in, for example, Jpn. Pat. No. 2816217, a recording apparatus has been proposed which is provided with a support cancellation mechanism to separate a belt conveying section from a recording head substantially in parallel in order to secure a work area for Jam recovery between the belt conveying section and the recording head. That is, the belt conveying section is pivotally provided in a recording apparatus main body so that it pivots on a drive roller at one end where the endless belt is wound and hooked. In this configuration, when the cut sheet has caused jamming, the other end of the belt conveying section can be spaced from the recording head pivotally on the drive roller. Alternatively, a configuration has been proposed wherein a belt conveying section can ascend and descend while keeping in parallel with a recording head owing to an ascend/descend mechanism.

In this example, the recording head is composed of recording heads of four colors: black, yellow, magenta and cyan. Theses colors are arranged in series in a recording paper conveying direction. Thus, while recording paper is being conveyed from an upstream side to a downstream side by turning the endless belt, the four colors including black, yellow, magenta and cyan are superposed in order on the recording paper being conveyed, thereby forming a color image. In addition, such a recording head is held by a main body frame, and the ascendably/descendably configured belt conveying mechanism is also held to the main body frame via a link, an arm, etc.

On the other hand, if an attempt is made to obtain an image of a quality as high as photographic quality which has recently been needed by users, it is necessary to align the black, yellow, magenta and cyan recording heads arranged in series in the paper conveying direction, and to accurately set the distance between a surface to convey the recording paper and a surface to eject the recording head ink.

In the configuration of the recording apparatus described in Jpn. Pat. No. 2816217, the belt conveying section is vertically moved by the ascend/descend mechanism held by the main body frame so that the belt conveying section faces the recording head. Therefore, in this recording apparatus, if a slight deformation, distortion or the like is caused due to the vertical movement of the belt conveying section, it is not possible to maintain an accurate distance from the recording head to the belt conveying section, resulting in a significant decrease in the quality of a recorded image.

There is thus a desire for a belt conveying section with a strong configuration, i.e., one in which deformation does not occur. In such a configuration, the belt conveying section itself is increased in size and becomes significantly heavier. Consequently, frame rigidity is required to highly accurately position the belt conveying section and retain that position, which is not easy to achieve.

Thus, in the configuration of the recording apparatus in Jpn. Pat No. 2816217, the belt conveying section is vertically movable owing to the ascend/descend mechanism, such that the frame is loaded and the positional relation between the belt conveying section and the recording head cannot be reproduced as designed if even a slight deformation or distortion is caused during the transportation from a manufacturing site to an Installation site. There is therefore a problem of displacement which emerges in the superposing direction of colors of the ejected ink.

BRIEF SUMMARY OF THE INVENTION

An image recording apparatus of the present invention comprises: an image recording section configured to record an image all over the recording width of a recording medium; a recording medium conveying section which is disposed opposite to the image recording section and which holds the recording medium and which conveys the recording medium in a recording medium conveying direction perpendicular to a width direction of the recording medium; a space varying section which contacts at least one of the image recording section and the recording medium conveying section and which varies a space between the recording medium conveying section and the image recording section; and an engaging section which engages the recording medium conveying section with the image recording section and in which an engaging position and a disengaging position are selectable, wherein the engaging section is at the engaging position in at least a state where the image is recorded by the image recording section.

Furthermore, an image recording apparatus comprises: an image recording section configured to record an image all over the recording width of a recording medium; a recording medium conveying section which is disposed opposite to the image recording section and which holds the recording medium and which conveys the recording medium in a direction perpendicular to a width direction of the recording medium; and a space varying section which contacts at least one of the image recording section and the recording medium conveying section and which varies a space between the recording medium conveying section and the image recording section, wherein the space varying section is separated from at least one of the image recording section and the recording medium conveying section in at least a state where the image is recorded by the image recording section.

DETAILED DESCRIPTION OF THE INVENTION

Embodiments of the present invention will hereinafter be described in detail in reference to the drawings.

Figure 1:
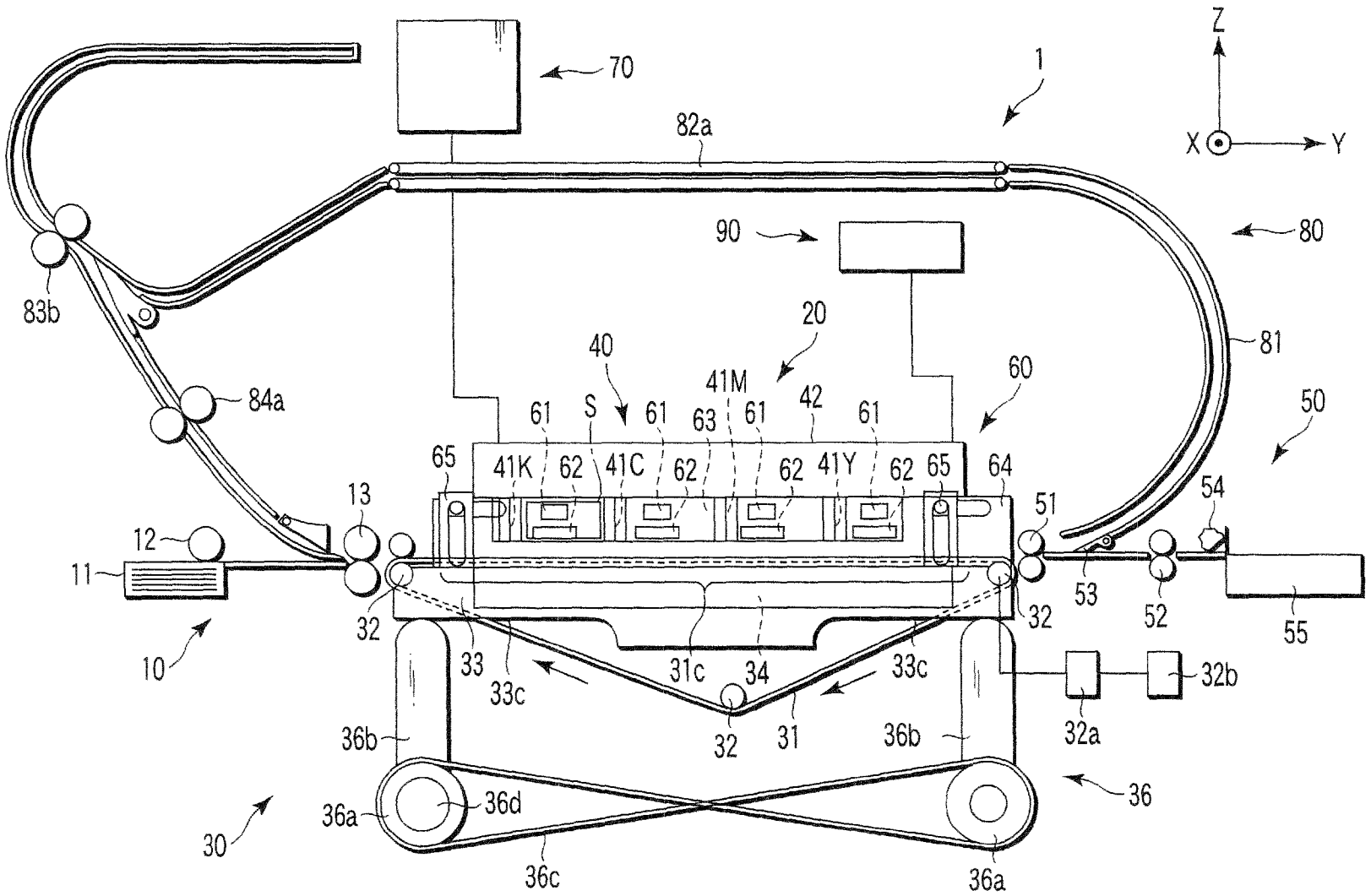
FIG. 1 is a diagram showing the schematic configuration of an image recording apparatus according to a first embodiment of the present invention.

FIG. 1 is a diagram showing the schematic configuration of an image recording apparatus according to a first embodiment of the present invention. In FIG. 1, an image recording apparatus 1 for image recording is installed in an apparatus frame 2 shown in FIG. 2, and comprises a paper feed section 10, an image recording mechanism 20, a discharge section 50, a maintenance section 60, an ink supply section 70, a recording medium inverting section 80 and a control section 90.

Figure 2:
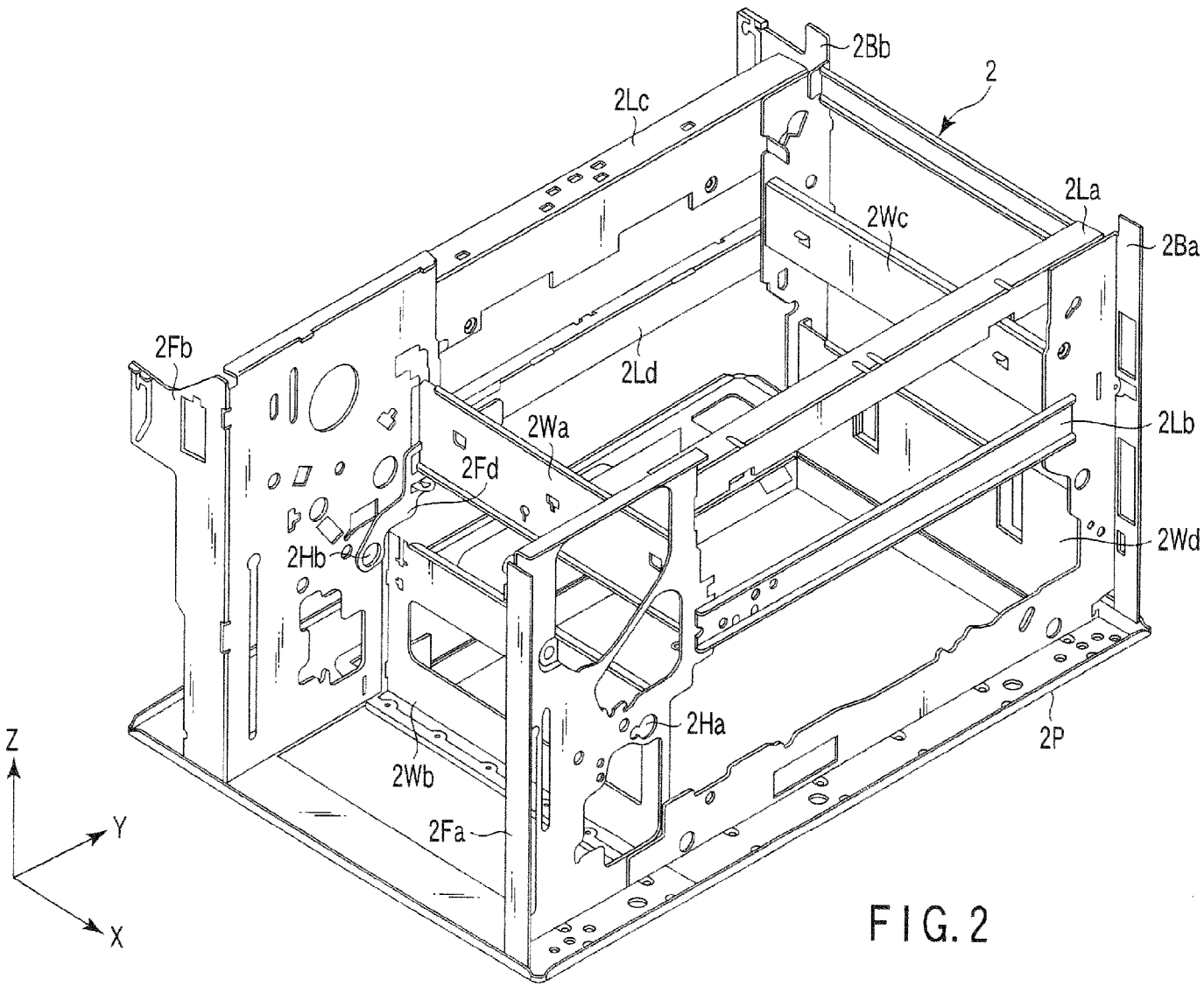
FIG. 2 is a diagram showing the schematic configuration of an apparatus frame used in the first embodiment.

First, the apparatus frame 2 will be explained referring to FIG. 2.

This apparatus frame 2 supports the paper feed section 10, the image recording mechanism 20, the discharge section 50, the maintenance section 60, the ink supply section 70, the recording medium inverting section 80 and the control section 90 mentioned above. Here, in the specification, the term "support" includes supporting a support target via at least another member and directly supporting it without another member. Moreover, it also includes fixedly, movably and rotatably supporting the support target.

In this case, the apparatus frame 2 has a rectangular base plate 2P. The base plate 2P is provided so that an upper surface thereof is horizontal when placed on a horizontal base surface. A pair of upright front sidewalls 2Fa and 2Fb on a paper feed side are provided on one side, corresponding to a paper supply side of the upper surface of the base plate 2P. On the other side, corresponding to a paper discharge side, a pair of upright paper discharge side L-shaped sidewalls 2Ba and 2Bb are provided.

Furthermore, the front sidewalls 2Fa and 2Fb are coupled by width direction coupling portions 2Wa and 2Wb. The paper discharge side L-shaped sidewalls 2Ba and 2Bb are coupled by width direction coupling portions 2Wc and 2Wd. Further, the paper feed side sidewall 2Fa and the paper discharge side L-shaped sidewall 2Ba are coupled by longitudinal coupling portions 2La and 2Lb. The paper feed side sidewall 2Fb and the paper discharge side L-shaped sidewall 2Bb are coupled by longitudinal coupling portions 2Lc and 2Ld. In such a configuration, the front sidewalls 2Fa and 2Fb and the rear L-shaped sidewalls 2Ba and 2Bb are fixed and supported on the base plate 2P.

The front sidewalls 2Fa and 2Fb are provided with member supporting portions 2Fc (not shown) and 2Fd to support parts constituting the image recording apparatus 1. Further, a hole 2Ha having a common axis is formed in the front sidewall 2Fa and the unshown member supporting portion 2Fc. In the same manner, a hole 2Hb having a common axis is formed in the front sidewall 2Fb and the member supporting portion 2Fc. These two holes 2Ha and 2Hb are used to axially support a registration roller pair 13 described later. Moreover, the width direction coupling portion 2Wc is provided with a support member (not shown) which supports the rear portion of a carriage 42 described later at one point.

Next, the paper feed section 10 will be explained.

This paper feed section 10 has at least one recording medium tray 11. For this recording medium tray 11, there are disposed a pickup roller 12 and the registration roller pair 13. The recording medium tray 11 is a recording medium storing unit to store at least two sheets of recording media. Here, a plurality of sheets of cut-sheet-shaped recording paper are contained as the recording media. It is to be noted that a recording medium storing unit which stores roll-type recording media can also be used as the recording medium tray 11.

The pickup roller 12 is a recording medium pickup mechanism which enables the recording media in the recording medium tray 11 to be picked up one by one. This pickup roller 12 is rotatably supported by the front sidewalls 2Fa and 2Fb of the above-mentioned apparatus frame 2. The registration roller pair 13 is a conveying direction adjustment mechanism which aligns the recording medium picked up by the pickup roller 12 with a conveying direction (recording medium conveying direction) during image recording.

The registration roller pair 13 is rotatably supported by the holes 2Ha and 2Hb of the above-mentioned apparatus frame 2. Of the rollers, one roller can be rotated by the image recording mechanism 20 described later, while the other roller can be rotated by a lever operable by a user. In the registration roller pair 13 in this embodiment, one roller shown on the upper side of the drawing is a coupled driving roller, while the other roller shown on the lower side of the drawing is a driving roller. Moreover, the registration roller pair 13 is disposed at a distance equal to or smaller than the size of the recording medium from the pickup roller 12 in the recording medium conveying direction, and ensures that the recording medium from the pickup roller 12 can be delivered.

It is to be noted that in the present specification, a shaft center along the conveying direction of the recording medium sent out of the registration roller pair 13 is defined as a Y axis (horizontal direction in FIG. 1). Further, in a surface (image forming surface) of the recording medium in which an image is formed during the image recording described later, a shaft center perpendicular to the Y axis is defined as an X axis (direction perpendicular to the surface of the drawing in FIG. 1). Still further, a shaft center perpendicular to the X axis and Y axis is defined as a Z axis (vertical direction in FIG. 1).

The registration roller pair 13 brings the width direction of the recording medium substantially into coincidence with the X axis direction, and brings a direction perpendicular to the width direction of the recording medium into coincidence with the Y axis. Moreover, the registration roller pair 13 also performs the operation of a recording medium conveying section to convey the aligned recording medium to the image recording mechanism 20 side. In addition, the recording medium being conveyed has its rear end nipped by the pickup roller 12 even when its tip has reached the registration roller pair 13. Thus, the registration roller pair 13 is assisted in conveying the recording medium by the pickup roller 12 until it nips at least the tip of the recording medium.

It is to be noted that in the present specification, a path on which the recording medium picked out by the pickup roller 12 is conveyed to the image recording mechanism 20 is called a fed paper conveying path. This fed paper conveying path extends from the pickup roller 12 to the boundary between the paper feed section 10 and the image recording mechanism 20 along the recording medium conveying direction. Moreover, the pickup roller 12 and the registration roller pair 13 are connected to an unshown common driving force transfer system, and are provided with a driving force from this driving force transfer system. An unshown motor is connected to this driving force transfer system, and the driving force is given thereto by this motor. Further, an encoder is connected to this motor, and can detect the number of revolutions. The motor and the encoder are connected to the control section 90, and driven under the control of the control section 90. That is, this driving force transfer system is connected to the control section 90, and driven in accordance with an instruction of the control section 90. Moreover, each of the pickup roller 12 and the registration roller pair 13 is configured to freely cancel the connection to the driving force transfer system by a clutch. The clutches are connected to the control section 90, and turned on/off under the control of the control section 90. Moreover, the pickup roller 12 and the registration roller pair 13 are configured to be rotatable on the X axis.

Next, the image recording mechanism 20 will be explained.

Figure 3A:
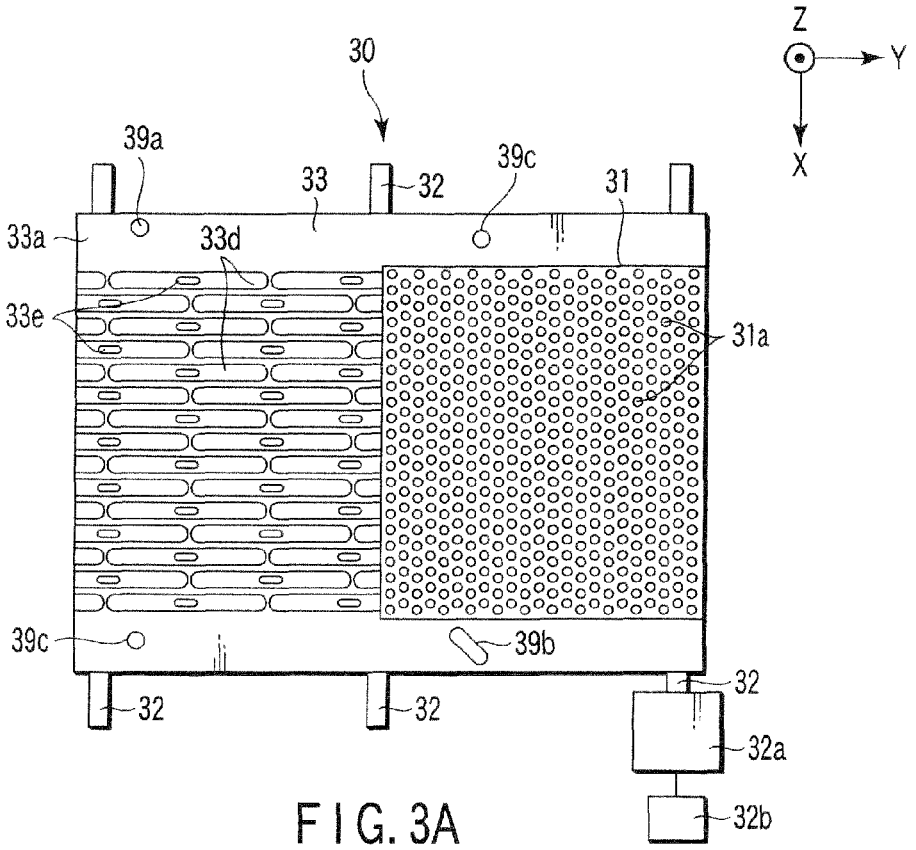
FIGS. 3A and 3B are diagrams showing the schematic configuration of a platen section used in the first embodiment.
Figure 3B:
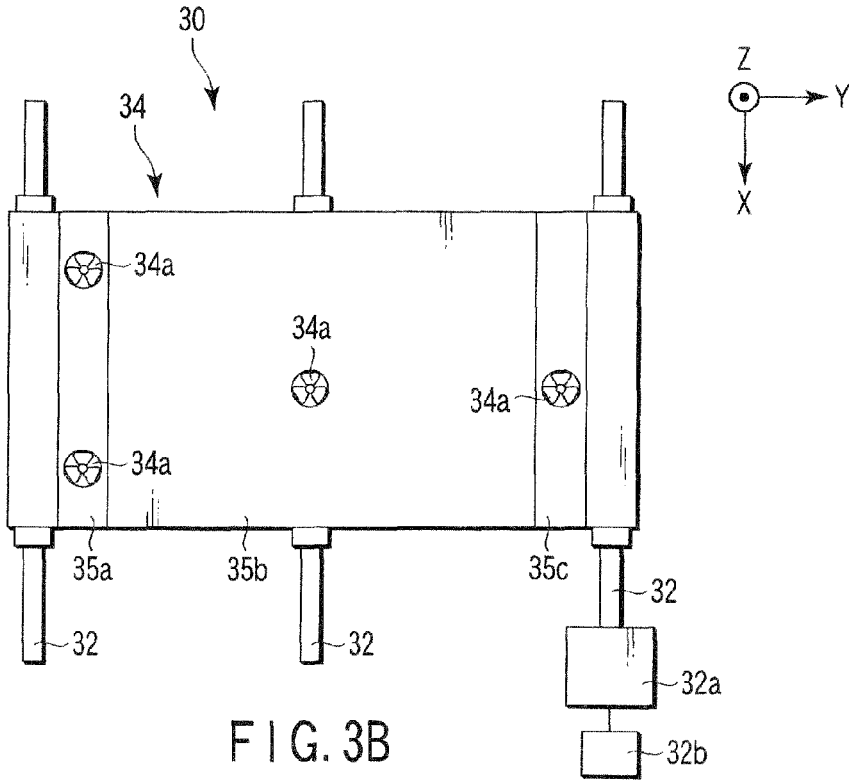

This image recording mechanism 20 has a platen section 30 and an image recording section 40. The platen section 30 is a recording medium conveying mechanism which conveys the recording medium sent from the paper feed section 10 during the image recording. As shown in FIG. 1 and FIGS. 3A and 3B, the platen section 30 has a platen belt 31 with a large number of suction holes 31*a*, a plurality of platen belt rollers 32, a platen frame 33, a platen suction unit 34 and a platen driving unit 36. In this case, only around half of the platen belt 31 is shown on the Y axis in FIG. 3A, for the purpose of explanation.

The platen belt 31 comprises an endless belt and is suspended by the plurality of platen belt rollers 32, and they cooperate to constitute a belt conveyer to carry the recording medium along the Y axis. It is to be noted that the platen belt 31 and the platen belt rollers 32 set the conveying direction of the paper during recording. That is, the platen belt 31 and the platen belt rollers 32 are assembled so that the recording medium can be conveyed along the whole Y axis path.

The plurality of platen belt rollers 32 support the platen belt 31 in an area where the platen belt 31 faces the image recording section 40 so that the platen belt 31 is parallel with the X axis and Y axis. Thus, the recording medium is conveyed by the platen belt 31 in the area where it faces the image recording section 40. It is to be noted that this area is called a platen recording medium conveying area, and is indicated by a reference numeral 31*c* in FIG. 1.

A belt roller driving motor 32*a* to rotate the platen belt rollers 32 is connected to at least one of the platen belt rollers 32. Moreover, the driven roller is disposed at a position where it faces, on the Z axis, the platen belt rollers 32 disposed at both ends on the Y axis, thereby preventing the rising of the recording medium.

Furthermore, an encoder (not shown) which generates a head control pulse is provided in the platen belt roller 32 (the platen belt roller shown on the left side in FIG. 1) opposite to the platen belt roller 32 driven by the motor. Further, the belt roller driving motor 32*a* is provided with a motor control encoder (not shown) to control the driving of the motor.

Furthermore, a roller encoder 32*b* which counts the number of revolutions of the belt roller driving motor 32*a* is connected to the belt roller driving motor 32*a*. It is to be noted that the belt roller driving motor 32*a* and the roller encoder 32*b* are connected to the control section 90.

The platen frame 33 rotatably supports the platen belt rollers 32, and holds the platen suction unit 34 shown in FIG. 3B. The platen frame 33 has a platen frame head facing surface 33*a* which faces the image recording section 40 (FIG. 3A). The platen frame head facing surface 33*a* is parallel with a surface along the X axis and the Y axis, and has a plurality of grooves 33*d* extending in the Y direction over the whole area facing the platen belt 31. A facing surface hole 33*e* is provided substantially in the center of each of the grooves 33*d* to penetrate corresponding platen chambers 35*a*, 35*b* and 35*c* described later.

The platen suction unit 34 is a negative pressure generator which generates negative pressure in the platen frame head facing surface 33*a*. This platen suction unit 34 is fixed to the platen frame 33 opposite to the platen frame head facing surface 33*a*.

Thus, in the platen section 30, the platen frame 33, the first to third platen chambers 35*a*, 35*b* and 35*c*, and a platen chamber negative pressure generation source 34*a* constitute a suction mechanism to stick to and hold the recording medium to be conveyed.

The platen driving unit 36 which forms space varying section has a pair of platen driving unit rotation shafts 36*a*. The platen driving unit rotation shafts 36*a* are arranged at both ends of the platen section 30 on the Y axis so that they face each other on the Y axis, as shown in FIG. 1. More specifically, one platen driving unit rotation shaft 36*a* (left in FIG. 1) and the other platen driving unit rotation shaft 36*a* (right in FIG. 1) face each other in the Y axis direction, and are located under both ends of the platen section 30 on the Y axis.

A platen section positioning mechanism will be explained by use of FIG. 4 to FIG. 7.

Figure 5:
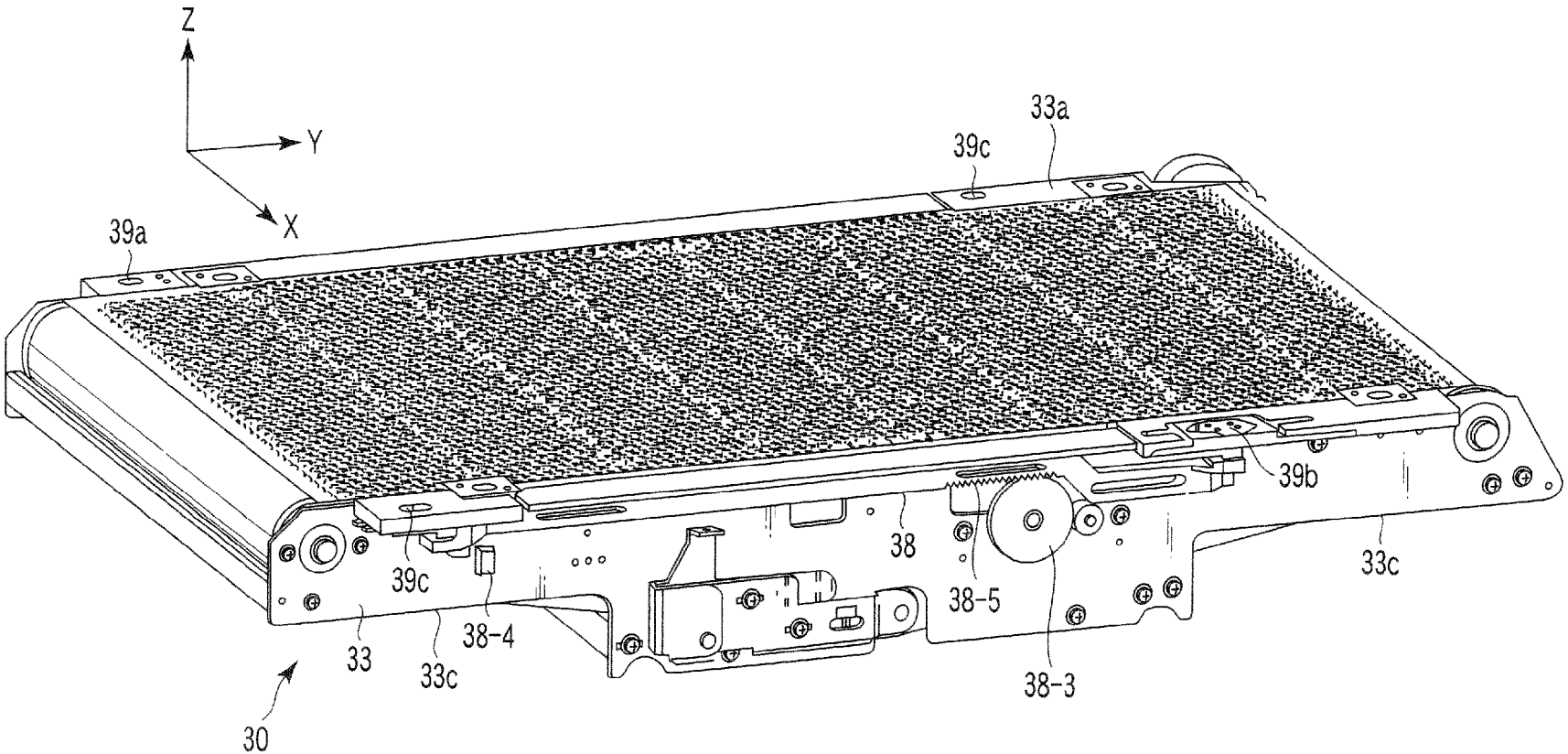
FIG. 5 is a diagram showing the schematic configuration of the platen section positioning mechanism used in the first embodiment.

The platen frame head facing surface 33*a* has platen guide holes 39*a*, 39*b* and 39*c* for alignment with the image recording section 40, in an area (non-platen area) where it does not face the platen belt 31 (see FIG. 5). In the present embodiment, the platen guide holes are provided at four places in total; the platen guide holes 39*c* and 39*a* on the front and rear sides upstream in the conveying direction of the recording medium, and the platen guide holes 39*b* and 39*c* on the downstream front and rear sides, respectively. It is to be noted that a Y(+) side is called a downstream side, a Y(−) side is called an upstream side, an X(+) side is called a front side, and an X(−) side is called a rear side.

Figure 6:
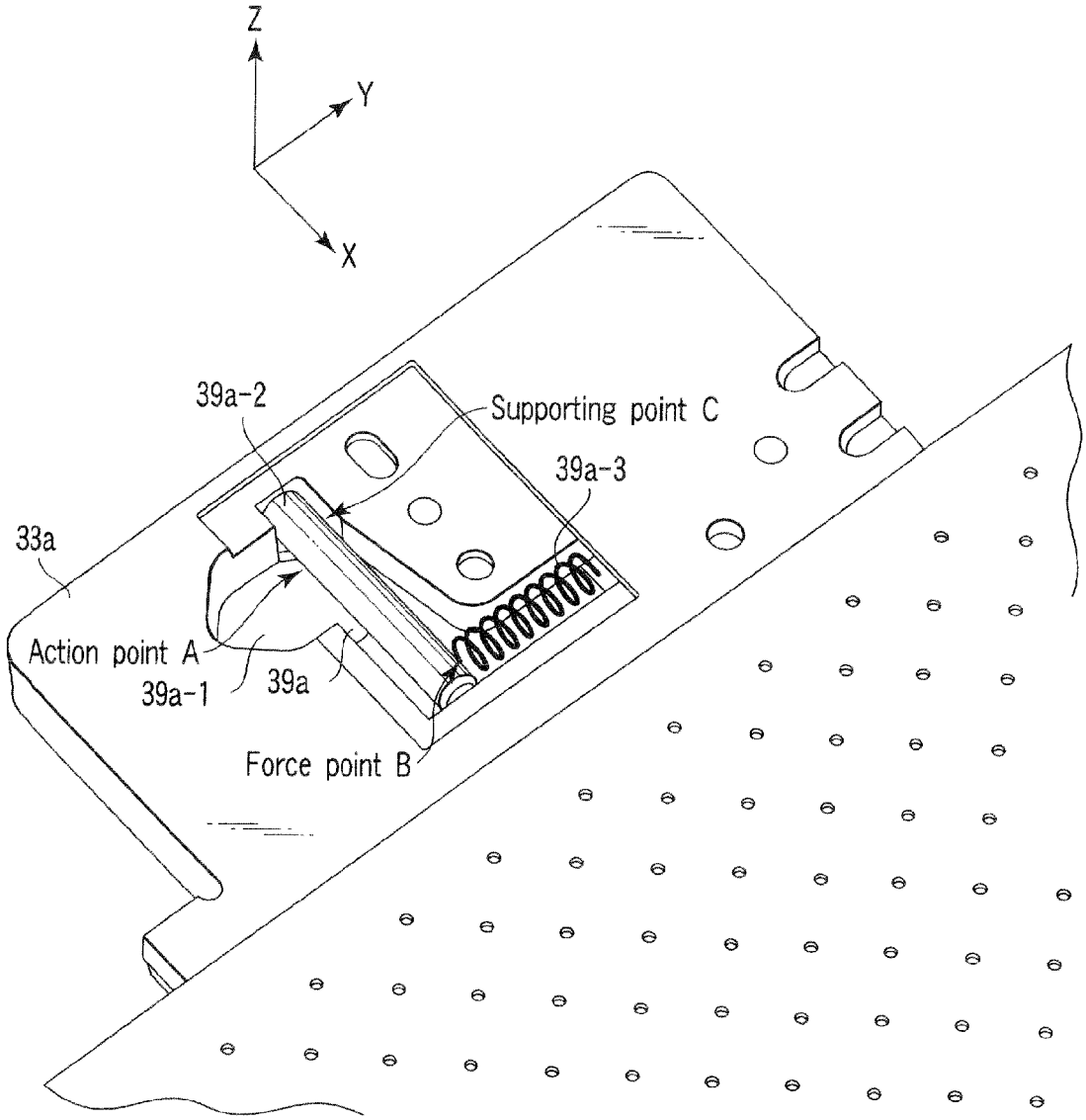
FIG. 6 is a diagram showing the schematic configuration of a platen guide hole used in the first embodiment.
Figure 7:
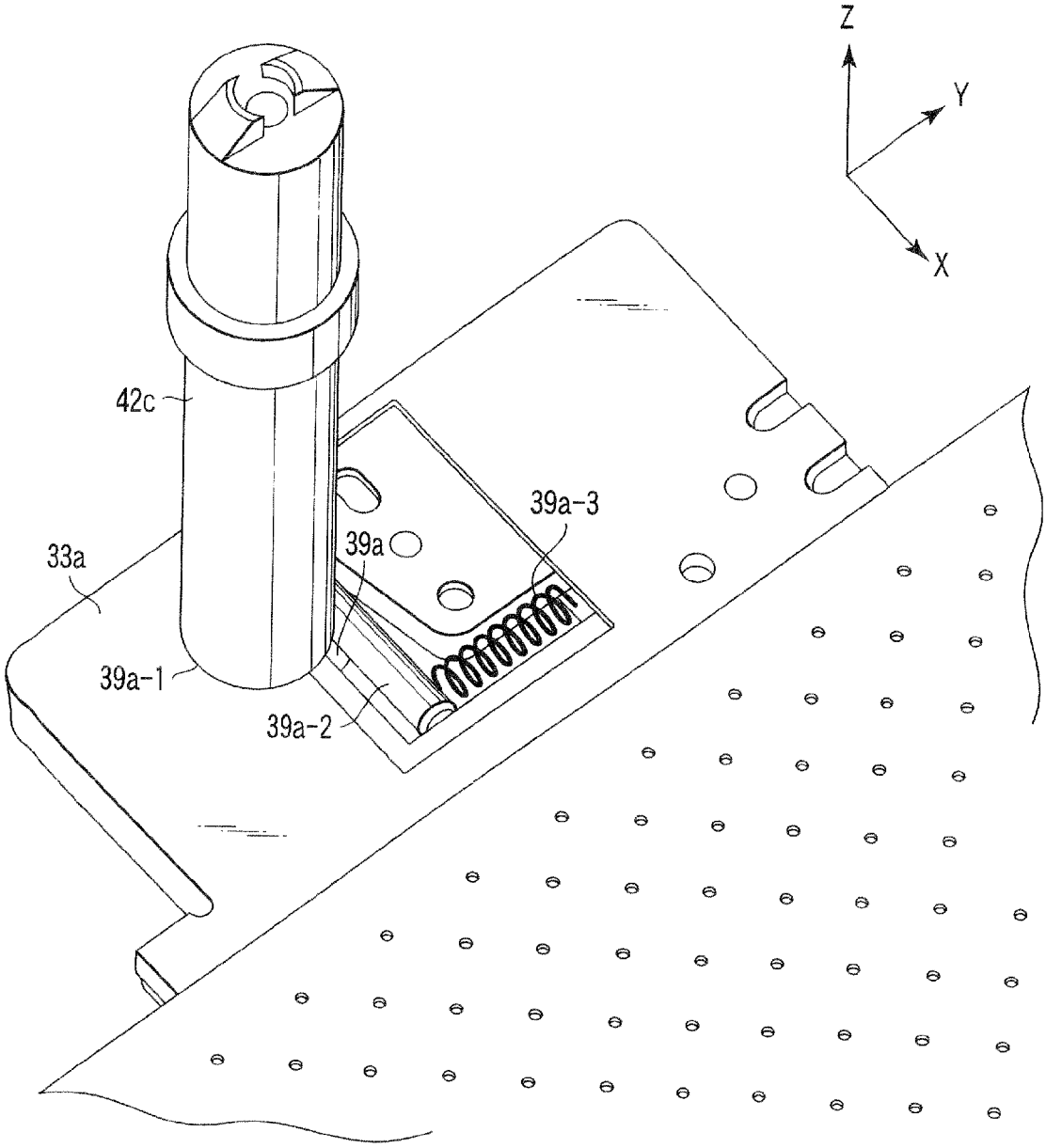
FIG. 7 is a diagram showing the schematic configurations of the platen guide hole and a pin used in the first embodiment.

In the platen guide hole 39*a* provided on the upstream rear side of the platen frame head facing surface 33*a*, a depression 39*a*-1 is formed in an upstream side surface as shown in FIG. 6. This depression 39*a*-1 is formed so that the upstream side surface is perpendicularly shaped. A pin 42*c* as a first fit portion which forms engaging section provided in the carriage 42 described later is inserted through the depression 39*a*-1 with the perpendicularly shaped upstream side surface (see FIG. 7). In the platen guide hole 39*a*, there is disposed a shaft-shaped parallel pin 39*a*-2 along the X axis direction at a position where it faces the depression 39*a*-1. One end of a spring 39*a*-3 is in contact with the tip of the parallel pin 39*a*-2, and the pin 42*c* is pressed against the side surface of the depression 39*a*-1 by the elastic force of this spring 39*a*-3. In this case, in the parallel pin 39*a*-2, there are a force point B on which the spring 39*a*-3 acts, a supporting point C, and an action point A in between, that is, a point contacting the pin 42*c*, wherein the distance between the supporting point C and the force point B is set to be twice as long as the distance between the supporting point C and the action point A. Thus, even if the amount of force of the spring 39*a*-3 is small, the amount of force acting on the pin 42*c* is great. The pin 42*c* is pressed against the side surface of the depression 39*a*-1 by this force such that a great amount of force can be obtained to position the platen section 30 at the carriage 42. Thus, even if the amount of force of the spring 39*a*-3 is small, a great amount of positioning force can be obtained, which is also advantageous for assemblability and workability of spring components. Moreover, because the parallel pin 39*a*-2 is configured so that it is merely put in the platen guide hole 39*a*, the parallel pin 39*a*-2 can freely rotate on its axis. When the pin 42*c* is inserted in or removed from the depression 39*a*-1, the parallel pin 39*a*-2 rotates on its axis, such that it is possible to reduce the resistance for the insertion and removal and to perform an operation with a small amount of insertion/removal force.

Furthermore, the platen guide hole 39*a* is provided with an unshown cover to cover the parallel pin 39*a*-2 and the spring 39*a*-3 except for a hole portion through which the pin 42*c* is inserted, in which configuration the parallel pin 39*a*-2 and the spring 39*a*-3 do not jump out.

The platen guide hole 39*b* disposed on the downstream front side is configured in a similar manner. In this case, although the platen guide hole 39*b* is not shown in detail, the platen guide hole 39*b* is formed by a long hole parallel with a line connecting the center of the platen guide hole 39*b* and the center of the platen guide hole 39*a*. An unshown pin is pressed against the longitudinal end of the long hole by the elastic force of the spring. The width of the platen guide hole 39*b* is the same as the diameter of the platen guide hole 39*a*, but the longitudinal dimension of the platen guide hole 39*b* is much greater than the dimension in the width direction. Moreover, the longitudinal direction of the platen guide hole 39*b* is inclined with respect to the X axis. The inclination of the platen guide hole 39*b* in the longitudinal direction at this point has an angle of about 45 degrees with respect to the X axis.

The remaining two platen guide holes 39*c* have a sufficiently large diameter for the diameter of the pin 42*c*, and are configured such that they do not impinge on the position of the pin positioned by the platen guide hole 39*a* and the platen guide hole 39*b*.

The platen driving unit 36 will be explained by use of FIG. 1, FIG. 5 and FIG. 8 to FIG. 10.

In this case, the platen frame 33 has two pairs of platen driving unit guides 33*c* to guide the platen driving unit 36. As shown in FIG. 5, these platen driving unit guides 33*c* are provided on the side opposite to the platen frame head facing surface 33*a* on the Z axis. Further, these pairs of platen driving unit guides 33*c* are provided at both ends of the platen frame 33 at positions separated in the Y axis direction and X axis direction. The platen driving unit guides 33*c* have guide surfaces along the Y axis, and extend over a predetermined distance from the ends of the platen frame 33.

Figure 8:
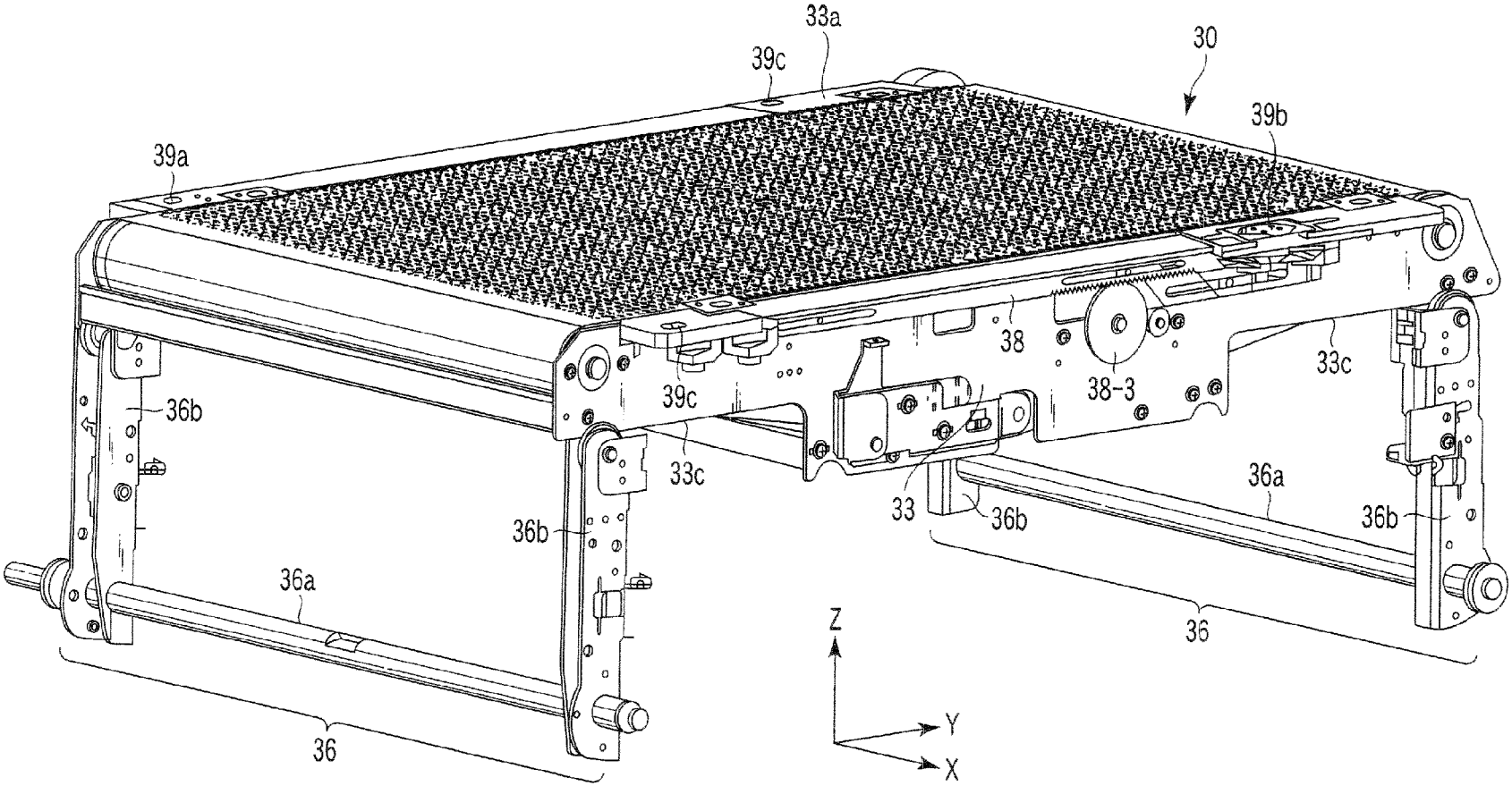
FIG. 8 is a diagram showing the schematic configuration of a platen drive section used in the first embodiment.

Each of the platen driving unit rotation shafts 36*a* extends along the Z axis, and rotates on the X axis. More specifically, as shown in FIG. 8, the platen driving unit rotation shafts 36*a* has such a dimension along the X axis as to face the platen driving unit guides 33*c* disposed at both ends of the platen frame 33 on the X axis. The pair of platen driving unit rotation shafts 36*a* are connected by a platen driving unit belt 36*c* (see FIG. 1) so that they can transfer their turning force to each other. Moreover, a platen driving unit motor 36*d* is connected to one of the pair of platen driving unit rotation shafts 36*a*. The rotation of the platen driving unit motor 36*d* causes the platen driving unit belt 36*c* to rotate and the pair of platen driving unit rotation shafts 36*a* to rotate synchronously with each other. The platen driving unit motor 36*d* is connected to the control section 90, and driven under the control of the control section 90.

Furthermore, the respective platen driving unit rotation shafts 36*a* support platen support portions 36*b* which are disposed in the Z axis direction in such a manner as to correspond to the platen driving unit guides 33*c* at both ends of the platen frame 33 in the X axis direction. That is, two platen support portions 36*b* are provided for each of the platen driving unit rotation shafts 36*a*.

Each of the platen support portions 36*b* has one end supporting the platen driving unit rotation shaft 36*a* and the other end in contact with the platen driving unit guide 33*c*. Therefore, four platen support portions 36*b* pivot along the platen driving unit guides 33*c* in accordance with the rotation of the platen driving unit rotation shafts 36*a*.

In such a configuration, the position of the platen frame 33 on the Z axis varies depending on the position of the platen support portions 36*b* to contact the platen driving unit guides 33*c*. That is, the platen frame 33 vertically moves in the Z axis direction in accordance with the driving of the platen driving unit rotation shafts 36*a*. It is to be noted that the platen frame 33 is disposed at an uppermost position in the Z axis direction when the platen support portions 36*b* are parallel with the Z axis direction.

Figure 9:
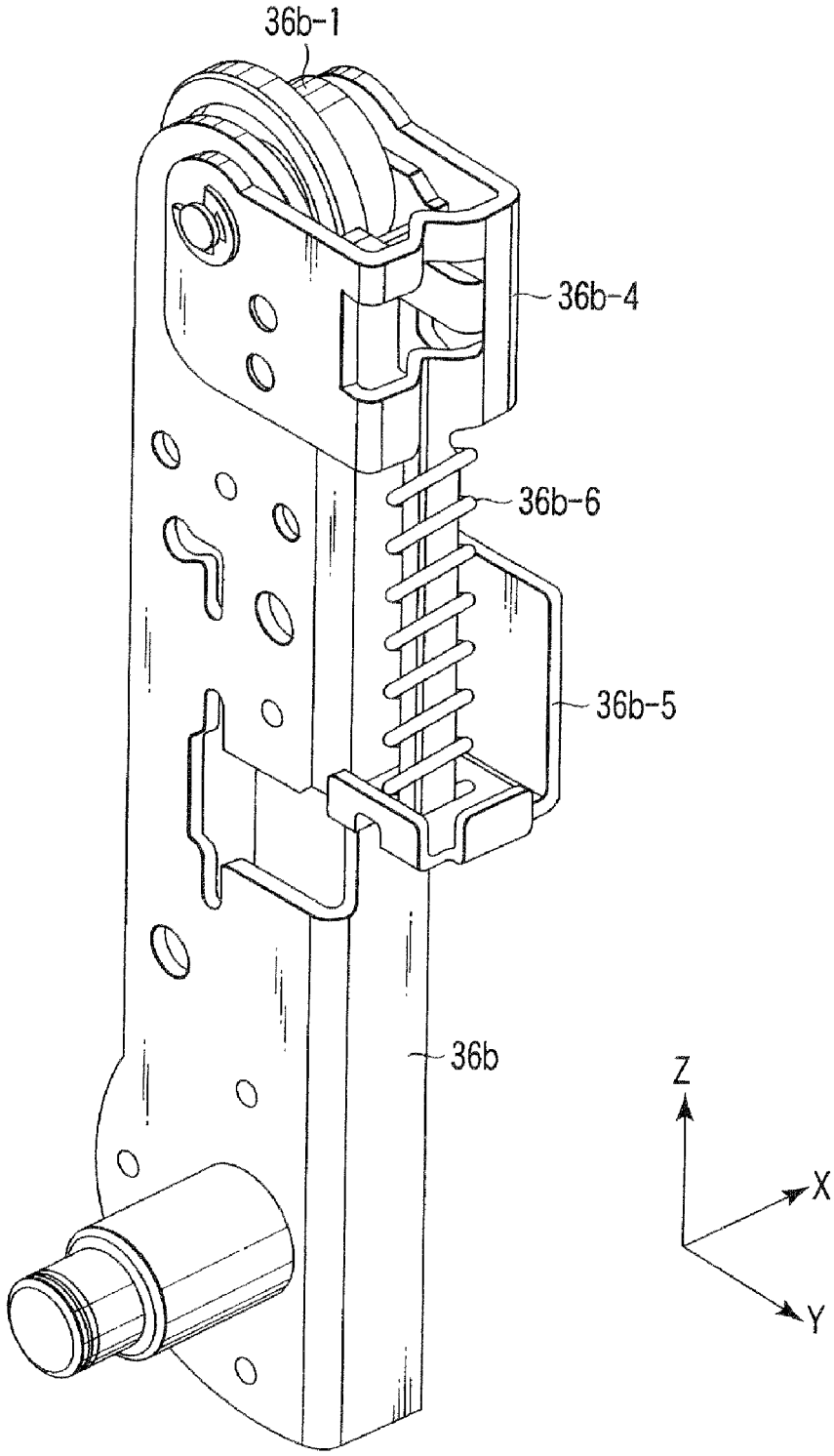
FIG. 9 is a diagram showing the schematic configuration of a platen support portion used in the first embodiment.
Figure 10:
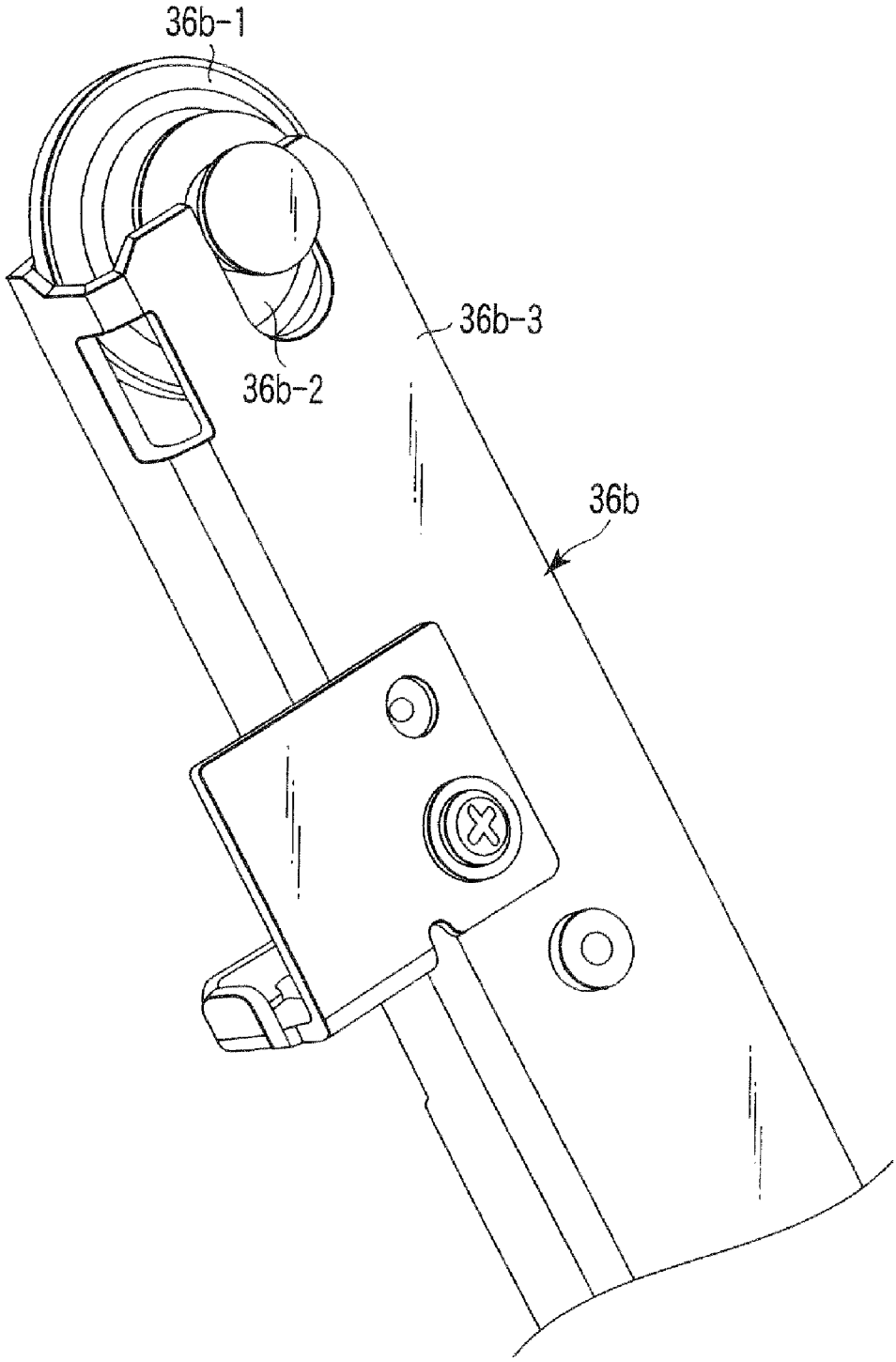
FIG. 10 is a diagram showing the schematic configuration of the platen support portion used in the first embodiment.

The platen support portion 36*b* has a roller 36*b*-1 which contacts the platen driving unit guide 33*c* and which moves the platen section 30 up and down while rotating, as shown in FIGS. 9 and 10. This roller 36*b*-1 has a rotation shaft inserted in a U-shaped long hole 36*b*-2 formed at the tip of an arm 36*b*-3. The roller 36*b*-1 can slide in the longitudinal direction of the platen support portion 36*b* along the U-shaped long hole 36*b*-2 (see FIG. 10). Further, the roller 36*b*-1 is provided with a bracket 36*b*-4. This bracket 36*b*-4 rotatably holds an unshown rotation shaft of the roller 36*b*-1, and slides over the arm 36*b*-3 together with the sliding of the roller 36*b*-1 along the long hole 36*b*-2 (see FIG. 9). Moreover, the bracket 36*b*-4 is supported by a bracket guide 36*b*-5. This bracket guide 36*b*-5 guides the movement of the bracket 36*b*-4 along the platen support portion 36*b* in the Z axis direction. A spring 36*b*-6 is placed between the bracket guide 36*b*-5 and the bracket 36*b*-4. This spring 36*b*-6 presses the bracket 36*b*-4 in the Z axis direction to push up the roller 36*b*-1.

Thus, predetermined pressurization is given from the spring 36*b*-6 to the roller 36*b*-1. The platen support portion 36*b* can push up the platen section 30 within a predetermined force amount owing to the roller 36*b*-1. The predetermined force amount in this case is the force amount sufficient to lift the platen section 30. However, when the amount of force equal to or greater than the predetermined force amount is applied to the platen support portion 36*b*, the spring 36*b*-6 is compressed without being able to resist the force amount at this moment, and the roller 36*b*-1 is pushed down and the platen section 30 moves downward.

Next, a rack mechanism 38 to suspend the platen section 30 from the carriage 42 will be explained.

Figure 4:
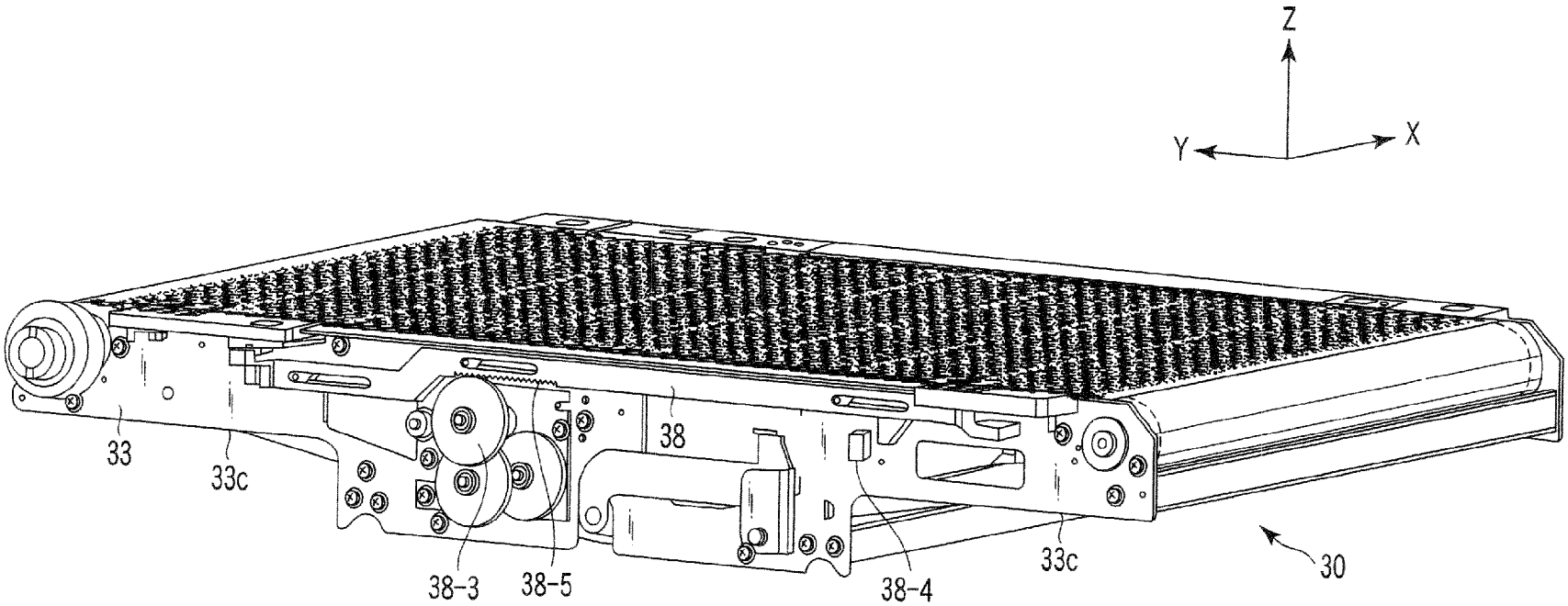
FIG. 4 is a diagram showing the schematic configuration of a platen section positioning mechanism used in the first embodiment.
Figure 11:
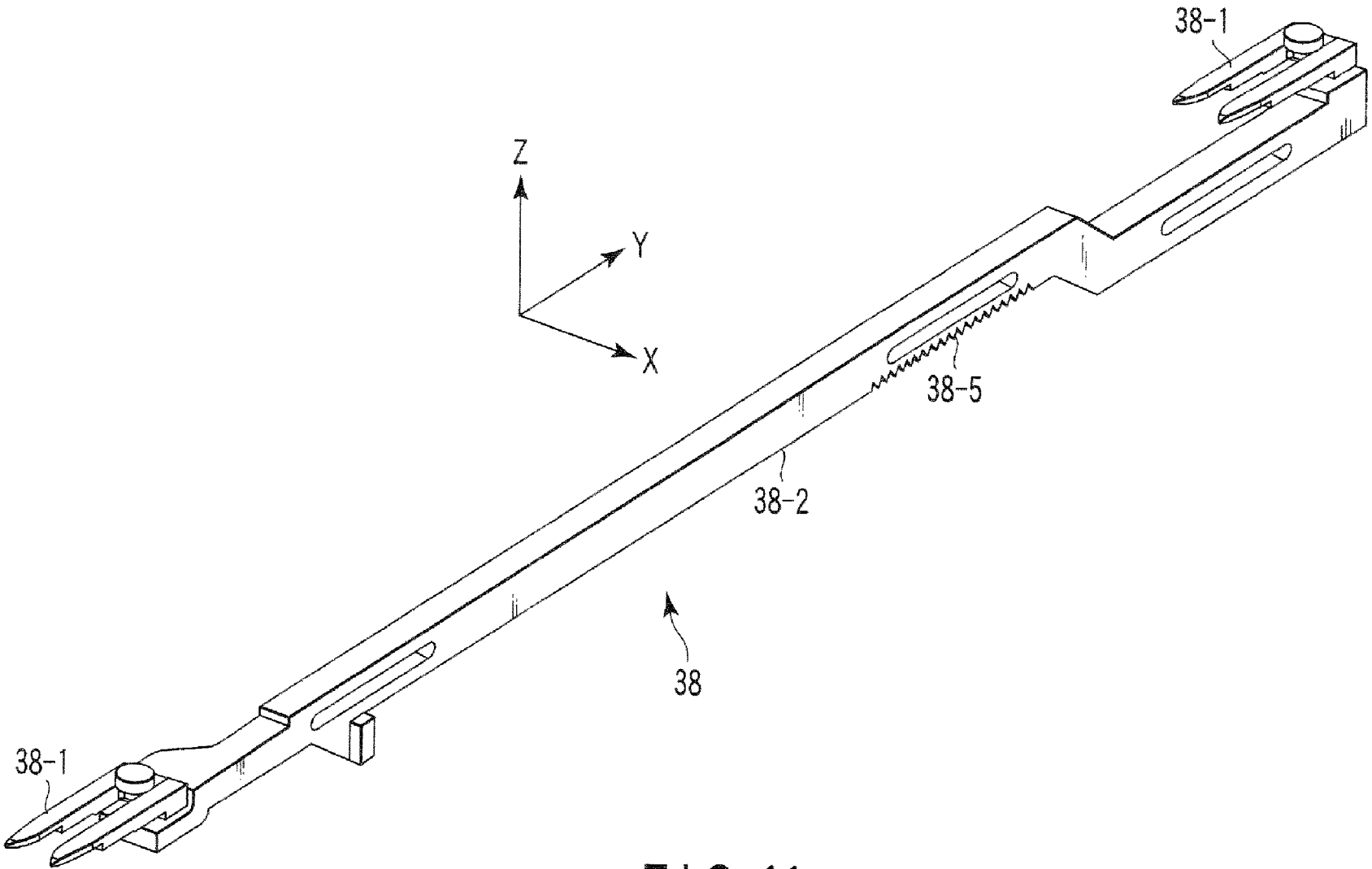
FIG. 11 is a diagram showing the schematic configuration of a rack mechanism used in the first embodiment.

In this case, the platen frame 33 of the platen section 30 is provided with the rack mechanisms 38 as second fit portions forming the engaging mechanism, on the front and rear sides (see FIGS. 4 and 5). The basic structure of the rack mechanism 38 engages with the pin 42*c* of the carriage 42 described later, as shown in FIG. 11. Slide hooks 38-1 to suspend the platen section 30 are provided at both ends of the carriage 42. These slide hooks 38-1 are pressed against a rack member 38-2 and under surface of the platen frame head facing surface 33*a* for movement to a engaging state position or an opening state position (disengaging state position) from the pins 42*c*. Thus, a spring (not shown) is provided to push up the slide hooks 38-1 from the rack member 38-2.

Figure 12:
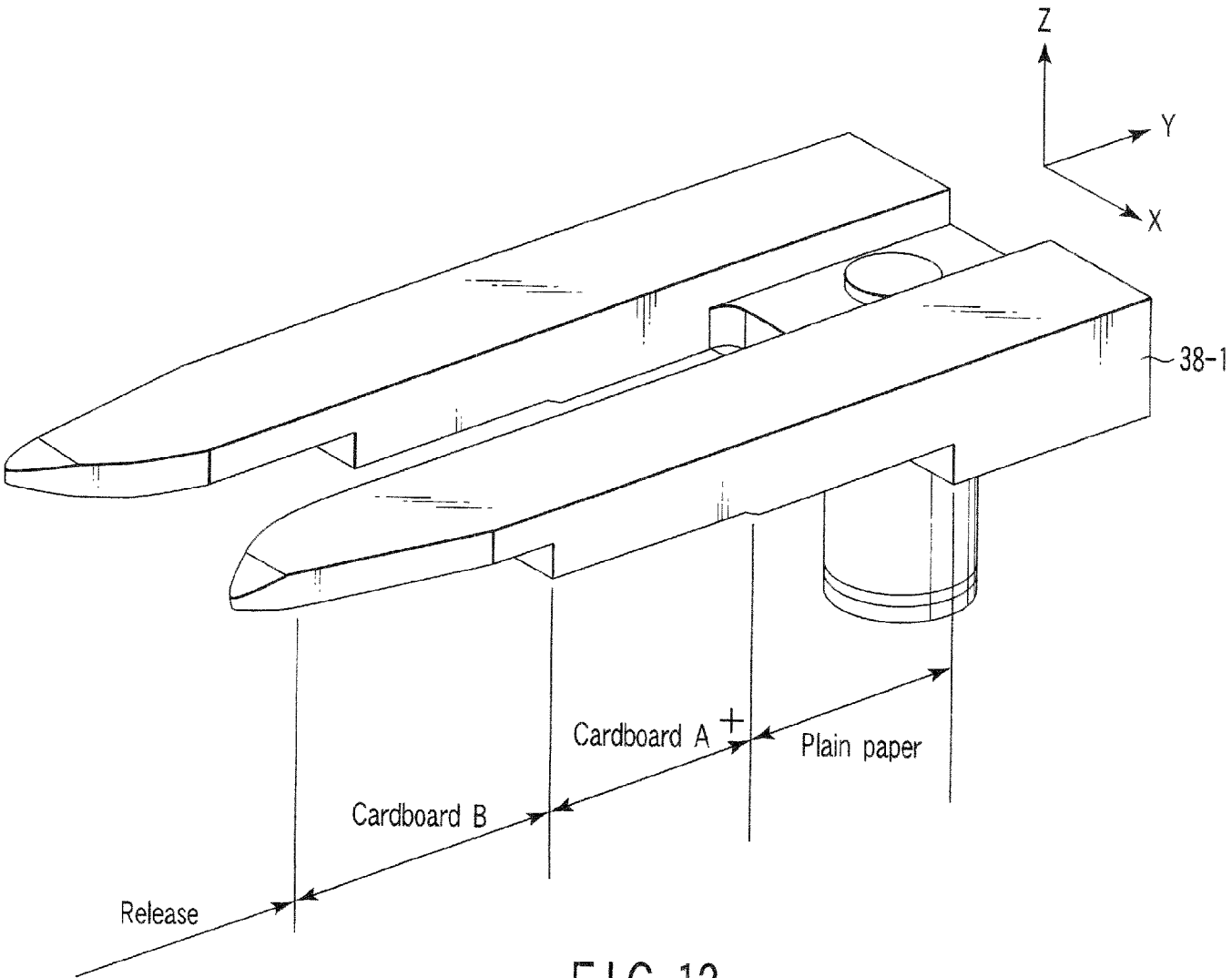
FIG. 12 is a diagram showing the schematic configuration of a slide hook of the rack mechanism used in the first embodiment.

Furthermore, the thickness of the slide hook 38-1 varies depending on the position in a moving direction as shown in FIG. 12, and in accordance with the thickness of the recording medium to be printed on, a plurality of positions can be taken: a plain paper position, a cardboard A position, a cardboard B position and a release position.

Furthermore, the slide hooks 38-1 disposed at both ends of the rack member 38-2 on the front side are provided at positions opposite to the platen guide holes 39*c* and 39*b* at both ends of the platen section 30 on the front side. The slide hooks 38-1 provided at both ends of the rack member 38-2 on the rear side are provided at positions opposite to the platen guide holes 39*a* and 39*c* at both ends of the platen section 30 on the rear side.

The rack members 38-2 on the front and rear sides are engaged with rack portions 38-5 provided substantially in the vicinity of the centers of the rack members 38-2 by rack driving gears 38-3. The rack members 38-2 are moved back and forth in the Y direction by the rotation of the rack driving gears 38-3. The rack driving gears 38-3 are driven by an unshown rack driving motor, and their positions are detected by a rack HPSW38-4 which is a state detector. The rack driving motor herein is a motor capable of controlling the rotational position, such as a pulse motor or a servomotor. More specifically, the rack HPSW38-4 detects a home position where the slide hook 38-1 is disengaged from the pin 42*c*, thus controlling the plain paper position, the cardboard A position and the cardboard B position of the slide hook 38-1 in accordance with the rotation angle of the rack driving motor from the home position (see FIGS. 4 and 5).

It is to be noted that the rack driving motors can also be placed on the front and rear sides to independently control on the front and rear sides. Further, the rack driving motor can also be placed on only one of the front and rear sides so that the driving force is transmitted to the other side to achieve collective control. Still further, even if there is no rack driving motor, it is possible to use the belt roller driving motor 32*a*, the platen driving unit motor 36*d* or the like for this purpose.

Next, the image recording section 40 will be explained.

Figure 15:
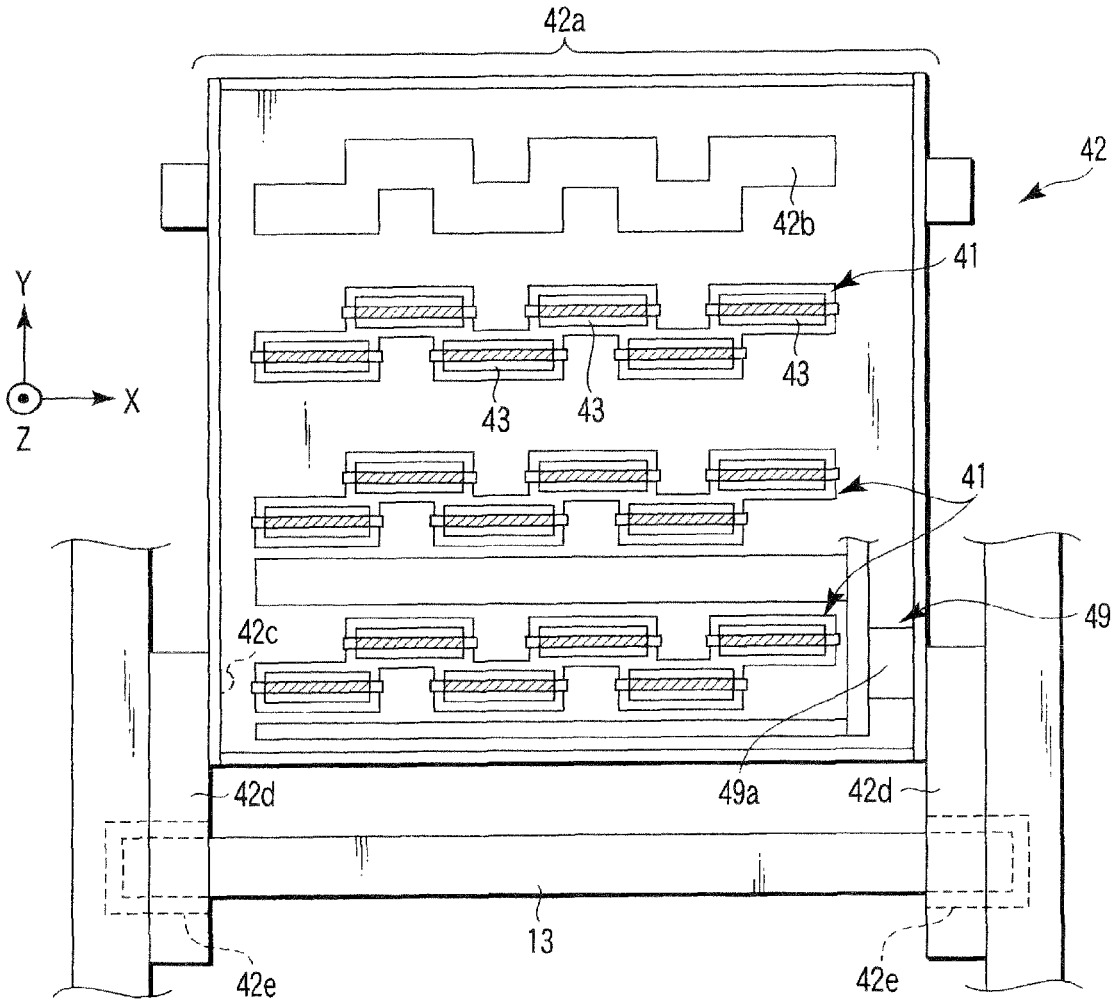
FIG. 15 is a diagram showing the schematic configuration of the carriage used in the first embodiment.

The image recording section 40 has an ink jet head to eject ink to the recording medium. As shown in FIG. 15, the image recording section 40 has a plurality of ink head lines 41 and a head cooler 49 in the carriage 42. These ink head lines 41 are an aggregate of a plurality of image recording units to record an image. That is, the ink head line 41 is provided for each color, and has a length equal to or larger than the maximum recording width of the recording medium to be used. It is to be noted that the image recording section 40 of the present embodiment has, as shown in FIG. 1, four ink head lines in total for black(K), cyan(C), magenta(M) and yellow(Y). Moreover, in the image recording section 40 in FIG. 1, indices (K, C, M and Y mentioned above) indicating corresponding colors are added to reference numerals indicating the ink head lines 41, for explanation purpose.

The carriage 42 comprises a head attachment portion 42*a* to which the ink head lines 41 are attached, carriage holes 42*b* to expose the ink head lines 41 to the recording medium, the carriage aligning pin 42*c* to align the platen section 30, and a pair of paper feed roller coupling portions 42*d*. Moreover, the ink head lines 41 attached to the head attachment portion 42*a* are configured such that the longitudinal directions of a plurality of ink head units are brought into coincidence with each other to linearly arrange the ink head units. These ink head lines 41 have a longitudinal dimension equal to or larger than the recording width of the recording medium so that an image can be recorded over the whole recording width of the recording medium used for image recording. That is, when the image recording section 40 is adapted to the recording over the total width of an A-3 sized recording medium, the width of the ink head lines 41 is set equal to or larger than the width of the A-3 sized recording medium. In the present embodiment, the ink head lines 41 are made up of six ink head units 43. It is to be noted that the number of ink head units 43 constituting the ink head lines 41 can be changed in accordance with the recording width of the recording medium to be used.

Figure 13:
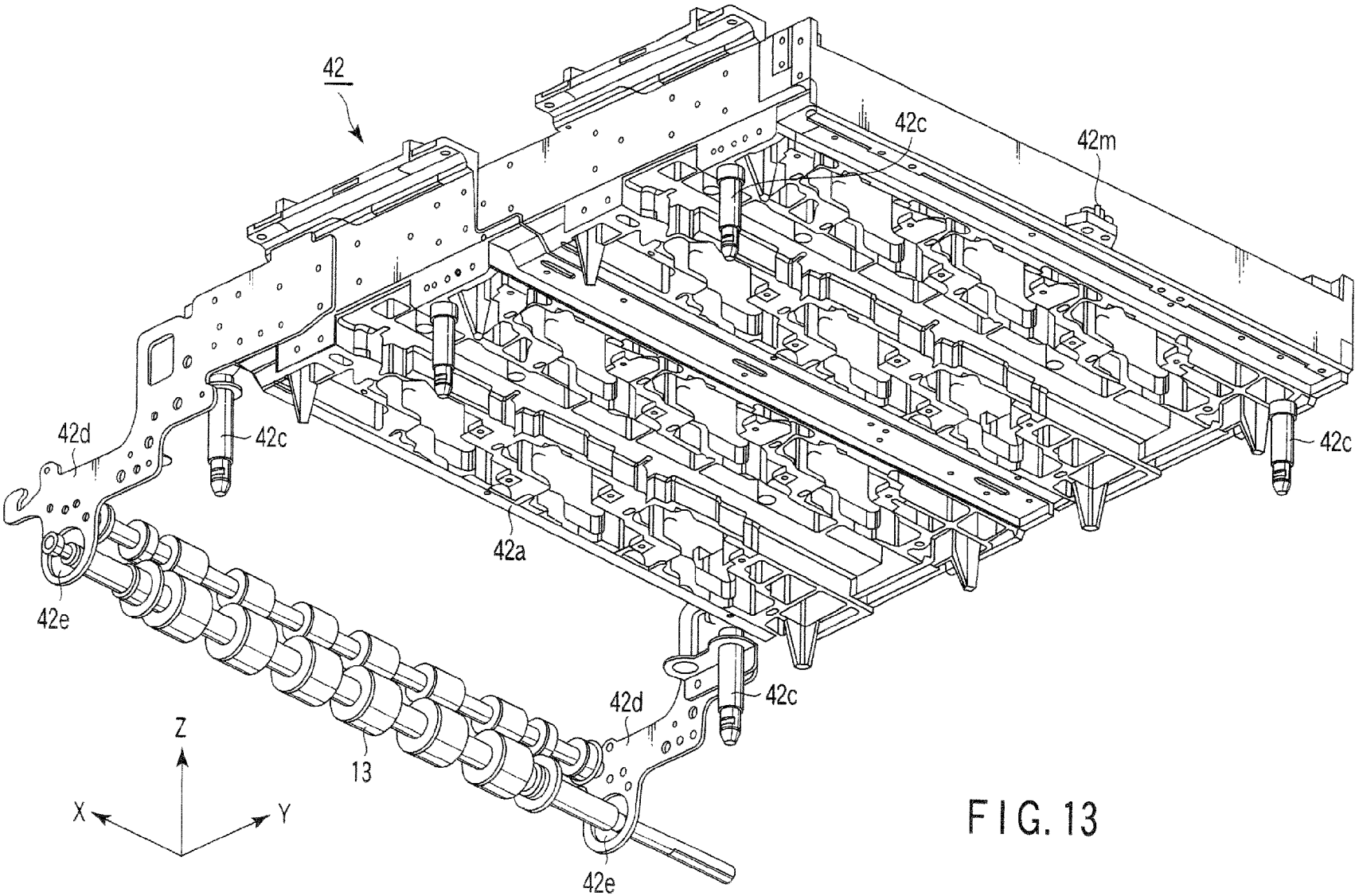
FIG. 13 is a diagram showing the schematic configuration of a paper feed roller coupling portion of a carriage used in the first embodiment.

Next, the carriage 42 will further be explained by use of FIG. 13.

First, the paper feed roller coupling portions 42*d* will be explained.

The pair of paper feed roller coupling portions 42*d* are fixed opposite to each other at both ends (front and rear sides) of the head attachment portion 42*a* on the X axis, as shown in FIG. 13. It is to be noted that the paper feed roller coupling portions 42*d* can also be configured integrally with the head attachment portion 42*a*. The pair of paper feed roller coupling portions 42*d* have a pair of paper feed roller bearings 42*e* which are bearings of one roller (lower roller in FIG. 13) of the registration roller pair 13. In other words, each of the pair of paper feed roller coupling portions 42*d* have a paper feed roller bearing 42*e*, and the paper feed roller bearings 42*e* constitute the bearing of the above-mentioned one roller. It is to be noted that the paper feed roller coupling portions 42*d* are omitted for simplification of the drawing in FIG. 1.

The pair of paper feed roller bearings 42*e* are provided to face each other in the width direction of the head attachment portion 42*a*. As described above, the pair of paper feed roller bearings 42*e* set the rotation center of one roller of the registration roller pair 13 in the width direction of the head attachment portion 42*a*.

Thus, the conveying direction of the recording medium by the registration roller pair 13 is set in the longitudinal direction of the head attachment portion 42*a*. Therefore, the longitudinal direction of the head attachment portion 42*a* is set to be parallel with the Y axis, which is the conveying direction of the recording medium. Further, the width direction of the head attachment portion 42*a* coincides with the X axis. Moreover, the paper feed roller bearings 42*e* fit into the two coaxial holes 2Ha and 2Hb described with FIG. 2 provided coaxially with the apparatus frame 2 and the paper feed roller coupling portions 42*d*, and are thus rotatably supported. This permits the carriage 42 to pivot on the axial center of the paper feed roller bearings 42*e* via the paper feed roller coupling portions 42*d*. In other words, the carriage 42 can pivot on the X axis.

Figure 14:
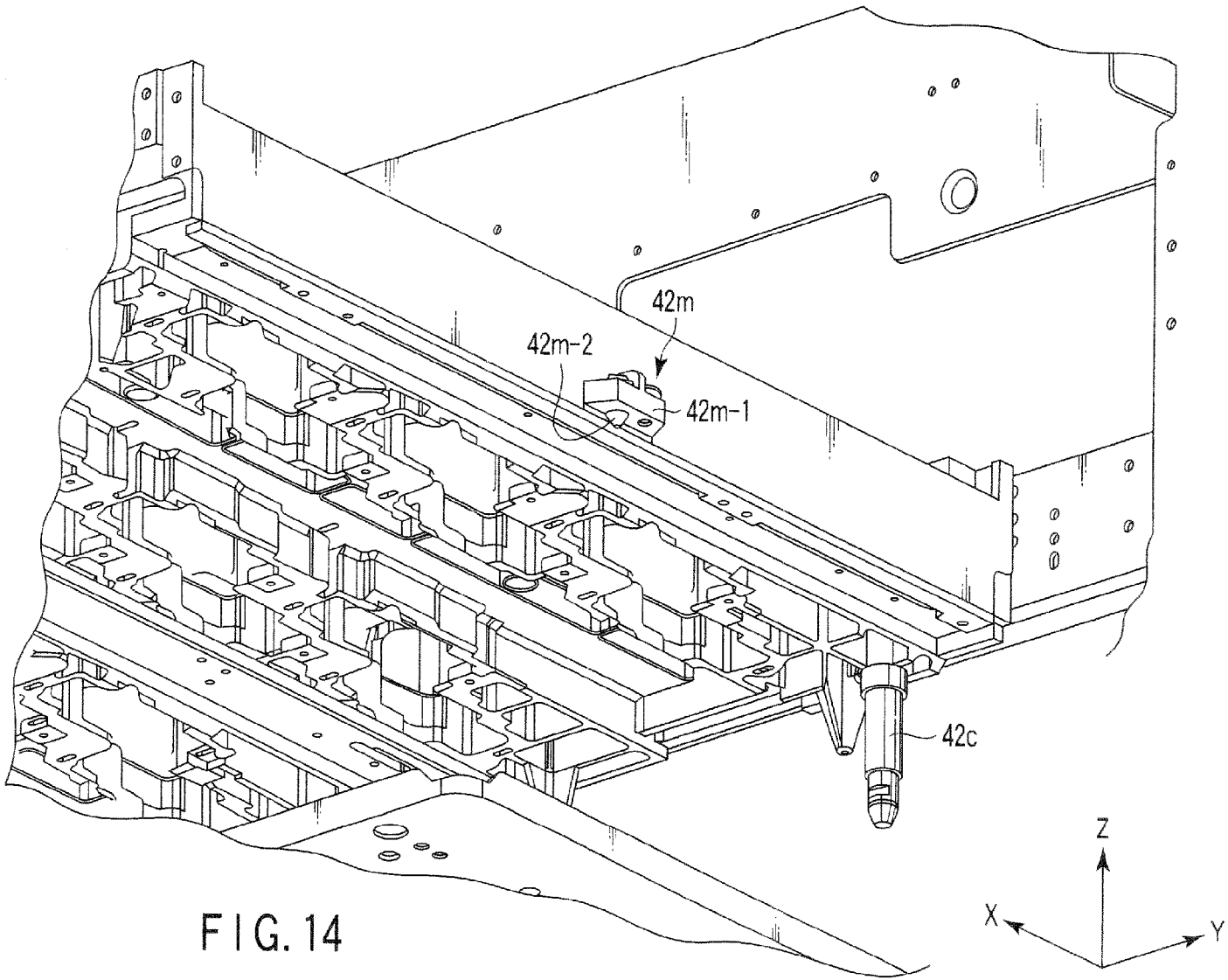
FIG. 14 is a diagram showing the schematic configuration of a paper discharge side support portion of the carriage used in the first embodiment.

Next, a paper discharge side support portion 42*m* of the carriage 42 will be explained by use of FIG. 14.

The protrusion-shaped paper discharge side support portion 42*m* is provided at a paper discharge side end of the carriage 42 substantially at the center of a paper width direction. This paper discharge side support portion 42*m* is integrated with the carriage 42, and has a protrusion 42*m*-1 and a conical portion 42*m*-2. The protrusion 42*m*-1 has a strength sufficient to support the weight of the entire carriage 42. The conical portion 42*m*-2 is provided under the protrusion 42*m*-1, and contacts a support member provided in the width direction coupling portion 2Wc of the apparatus frame 2 described with FIG. 2 to position the carriage 42 with respect to the apparatus frame 2 only in the Z direction and slidably hold it in the X and Y directions.

Thus, on the paper discharge side, the carriage 42 is held onto the apparatus frame 2 by the conical portion 42*m*-2 such that it is regulated only in the Z direction. Therefore, the carriage 42 is, on the paper discharge side, freely movable in rotating in the X direction, in the Y direction and on the Y axis and in rotating on the Z axis. Moreover, in the Z direction, the carriage 42 is merely regulated by the weight of the carriage 42 itself plus [the amount of force of a press spring (not shown) from the apparatus frame 2.] When the carriage 42 is subjected, from thereunder, to the amount of force above the weight of the carriage 42 itself plus the force amount of the press spring from the apparatus frame 2, the carriage 42 is lifted from the apparatus frame 2.

Thus, the carriage 42, on the paper discharge side, is rotatably held onto the apparatus frame 2 around the X axis on the paper feed roller bearings 42*e* via the paper feed roller coupling portions 42*d* and the registration roller pair 13. On the other hand, the carriage 42 is, on the paper discharge side, regulated in position only in the Z direction by the paper discharge side support portion 42*m*, so that the carriage 42 is configured to be able to, on the paper discharge side, move/rotate with respect to the apparatus frame 2 in the X direction, in the Y direction, around the Y axis and around the X axis even when the carriage 42 is deformed because an external force is applied to the apparatus frame 2.

Next, the pin 42*c* of the carriage 42 forming a link to the platen section 30 will be described.

The pins 42*c* are provided at four corners of the carriage 42 at positions corresponding to the platen guide holes 39*a*, 39*b* and 39*c* provided in the platen section 30 shown in FIG. 5 (see FIG. 13). The respective pins 42*c* engage with the platen guide holes 39*a*, 39*b* and 39*c* of the platen section 30. Further, the pins 42*c* are pressed against the platen section 30 by plunger mechanisms of the platen guide holes 39*a* and 39*b*, and accurately position the platen section 30 with respect to the carriage 42.

Figure 16:
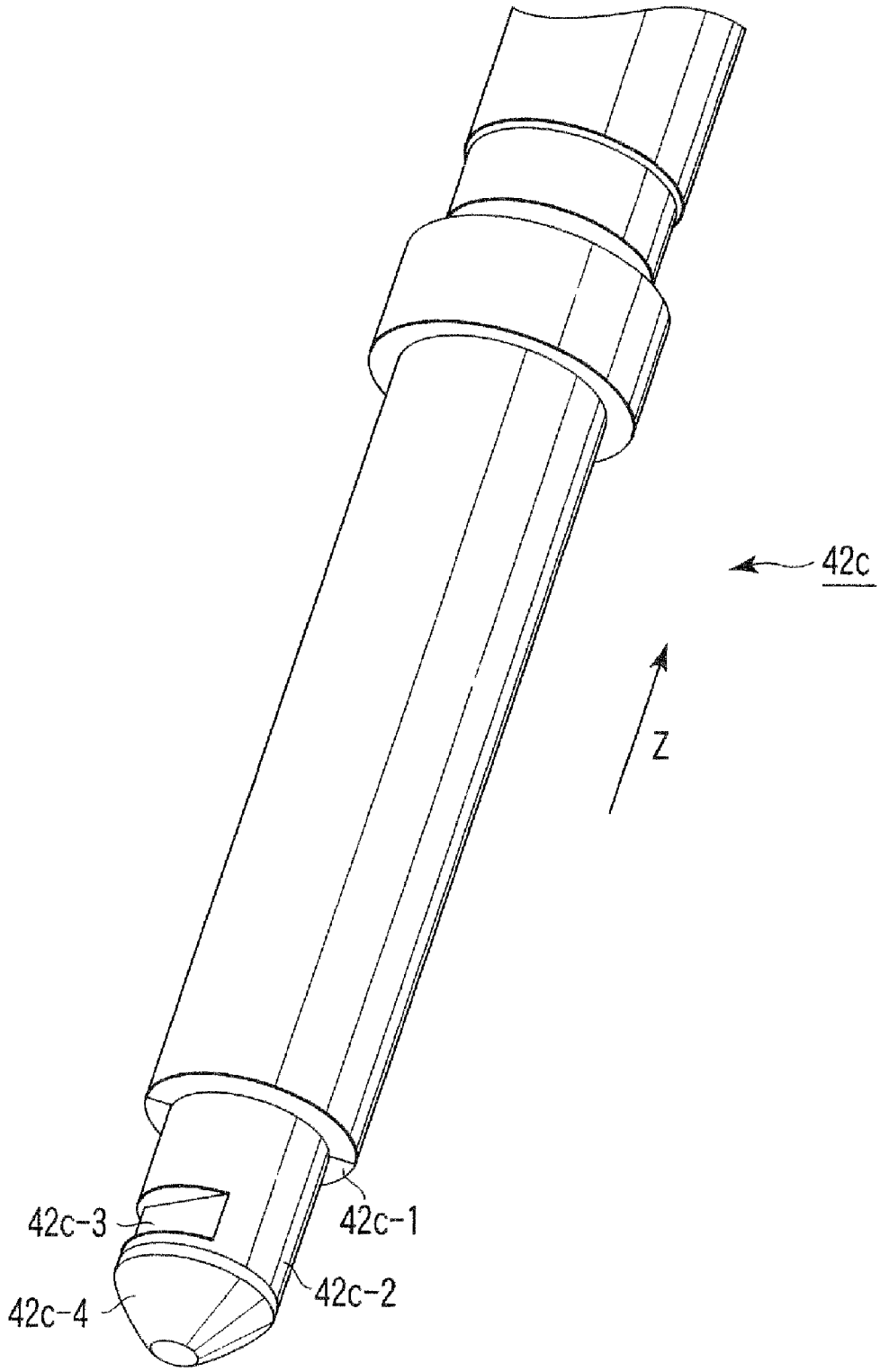
FIG. 16 is a diagram showing the schematic configuration of the pin used in the first embodiment.

As shown in FIG. 16, the pin 42*c* comprises a stepped surface 42*c*-1, a cylindrical surface 42*c*-2, a slit portion 42*c*-3 and a chamfered portion 42*c*-4. The stepped surface 42*c*1 collides with the platen frame head facing surface 33*a* of the platen section 30 lifted by the platen driving unit 36. The cylindrical surface 42*c*-2 engages with the platen guide hole 39*a* (39*b*, 39*c*), and contacts the perpendicularly shaped depression 39*a*-1. The slit portion 42*c*-3 is engaged with a slide hook 38 to suspend the platen section 30 from the carriage 42. The chamfered portion 42*c*-4 guides for smooth insertion into the platen guide hole 39*a* (39*b*, 39*c*) of the platen section 30. It is to be noted that the stepped surface 42*c*-1 is dimensioned so that a predetermined space is secured between the platen belt 31 and the ink head lines 41 even if the platen frame head facing surface 33*a* of the platen section 30 collides with the stepped surface.

Next, the discharge section 50 will be explained.

The discharge section 50 is a mechanism which discharges the recording medium on which an image has been recorded by the image recording mechanism 20. As shown in FIG. 1, the discharge section 50 has a discharge section conveying roller pair 51, a discharge section discharge roller pair 52, a path switching portion 53, a discharge assist portion 54 and a discharge tray 55. The discharge section conveying roller pair 51 is a recording medium conveyer which conveys the recording medium conveyed by the platen section 30 into the discharge section 50. The discharge section discharge roller pair 52 is a conveying roller which conveys the recording medium conveyed from the discharge section conveying roller pair 51 to the discharge tray 55. Thus, the recording medium is conveyed to the discharge section discharge roller pair 52 from the discharge section conveying roller pair 51, and the discharge section discharge roller pair 52 discharges the recording medium to the discharge tray 55. Therefore, a discharge path, which is a conveying path of the recording medium during discharge, is formed between the discharge section conveying roller pair 51 and the discharge tray 55. In the present embodiment, the discharge path extends along the Y axis.

Next, the maintenance section 60 will be explained.

As shown in FIG. 1, the maintenance section 60 has a plurality of maintenance units 61, a plurality of maintenance ink pans 62, a maintenance unit driver 63, a conveying direction guide frame 64, four ascend/descend guide frames 65 and position detecting means (not shown). The plurality of maintenance units 61 is provided to correspond to the positions of the four ink head lines 41. More specifically, the maintenance units 61 are arranged with a predetermined distance on the Y axis in the same manner as the arrangement of the ink head lines 41.

It is to be noted that the recording medium inverting section 80 provided in proximity to the discharge section 50 is conveying means for turning over the recording medium during double-side printing and again conveying the recording medium to the image recording mechanism 20.

Next, the control section 90 will be explained.

Figure 17:
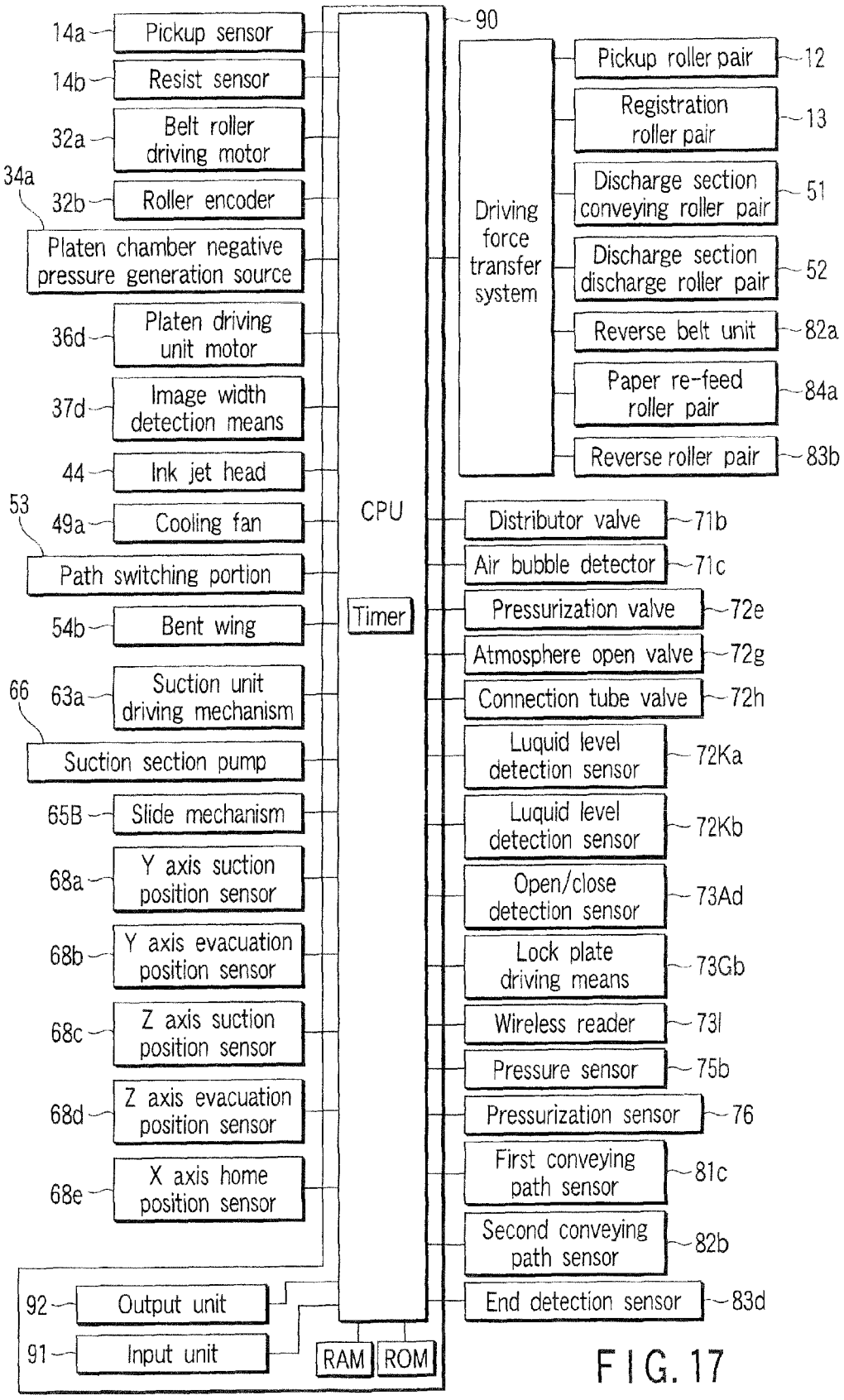
FIG. 17 is a diagram explaining a control section used in the first embodiment.

As shown in FIG. 17, the control section 90 comprises a computer including a CPU, a timer, a ROM, a RAM, etc. Moreover, the paper feed section 10, the image recording mechanism 20, the discharge section 50, the maintenance section 60, the ink supply section 70 and the recording medium inverting section 80 are connected to the control section 90, and the control section 90 controls the driving of these. More specifically, the control section 90 is connected to a pickup sensor 14*a* and a resist sensor 14*b* in the paper feed section 10. Further, in the paper feed section 10, the control section 90 controls the driving of the pickup roller 12 and the registration roller pair 13 via the driving force transfer system. Still further, in the platen section 30, the control section 90 is connected to the belt roller driving motor 32*a*, the roller encoder 32*b*, the platen chamber negative pressure generation source 34*a*, the platen driving unit motor 36*d* and an image width detector 37, and controls the driving of these. Further yet, in the image recording section 40, the control section 90 is connected to the ink head lines 41 and to a cooling fan 49*a* (see FIG. 15) of the head cooler 49, and controls the driving of these. Further yet, in the discharge section 50, the control section 90 is connected to the path switching portion 53 and a bent wing 54*b*, and controls the driving of these. In connection with this, the control section 90, in the discharge section 50, controls the driving of the discharge section conveying roller pair 51 and the discharge section discharge roller pair 52 via the driving force transfer system. Moreover, in the maintenance section 60, the control section 90 is connected to sensors of position detecting means 68, and information is sent to the control section 90 from these sensors. The sensors here include a Y axis suction position sensor 68*a*, a Y axis evacuation position sensor 68*b*, a Z axis suction position sensor 68*c*, a Z axis evacuation position sensor 68*d* and a X axis home position sensor 68*e*. Further, the control section 90 is connected to a suction unit driving mechanism 63*a*, a suction pump 66 and a slide mechanism 65B, and controls the driving of these. Still further, in the ink supply section 70, the control section 90 is connected to a distributor valve 71*b*, an air bubble detector 71*c*, a pressure valve 72*e*, an atmosphere open valve 72*g*, a connection tube valve 72*h*, a liquid level detection sensor 72*ka* and 72*kb*, an open/close detection sensor 73Ab, lock plate driving means 73Gd, a wireless reader 731, a pressure sensor 75*b* and a pressurization pump 76. The control section 90 controls the driving of these. Further yet, in the recording medium inverting section 80, the control section 90 is connected to a first conveying path sensor 81*c*, a second conveying path sensor 82*b* and an end detection sensor 83*d*, and controls the driving of these. Further yet, in the recording medium inverting section 80, the control section 90 controls the driving of a reverse belt unit 82*a*, a reverse roller pair 83*b* and a paper re-feed roller pair 84*a* via the driving force transfer system (see FIG. 1) Especially, the control section 90 also controls the driving of a counter-rotation mechanism of the reverse roller pair 83*b*. Moreover, the control section 90 has an input unit 91 for a user to carry out various settings, and an output unit 92 which outputs the above-mentioned settings, the state of the image recording apparatus, etc. The output unit 92 is configured to be able to perform audio output and displaying.

Next, the operation of the image recording apparatus configured as described above will be explained.

First, when an image is recorded by the image recording apparatus 1, image data is input to the control section 90 via un unshown interface. When the image data has been input, the control section 90 executes image recording processing.

First, the control section 90 causes the image recording apparatus 1 to evacuate the maintenance section 60. When the maintenance section 60 has been evacuated, the control section 90 checks that the rack HPSW38-4 (see FIG. 5) of the platen section 30 is turned on (the slide hook 38-1 is at the position to be released with respect to the pan 42*c*). Subsequently, the control section 90 rotates the platen driving unit motor 36*d*, and raises the platen section 30 in an arrow direction via the platen driving unit 36 (state (a) in FIG. 18). When the platen driving unit has reached an upper dead point, the platen frame head facing surface 33*a* of the platen section 30 collides with the stepped surface 42*c*-1 of the pin 42*c* of the carriage 42, and the platen driving unit 36 functions in a direction to lift the carriage 42 together with the maintenance section 60 via the platen section 30 and the pin 42*c*.

Figure 21:
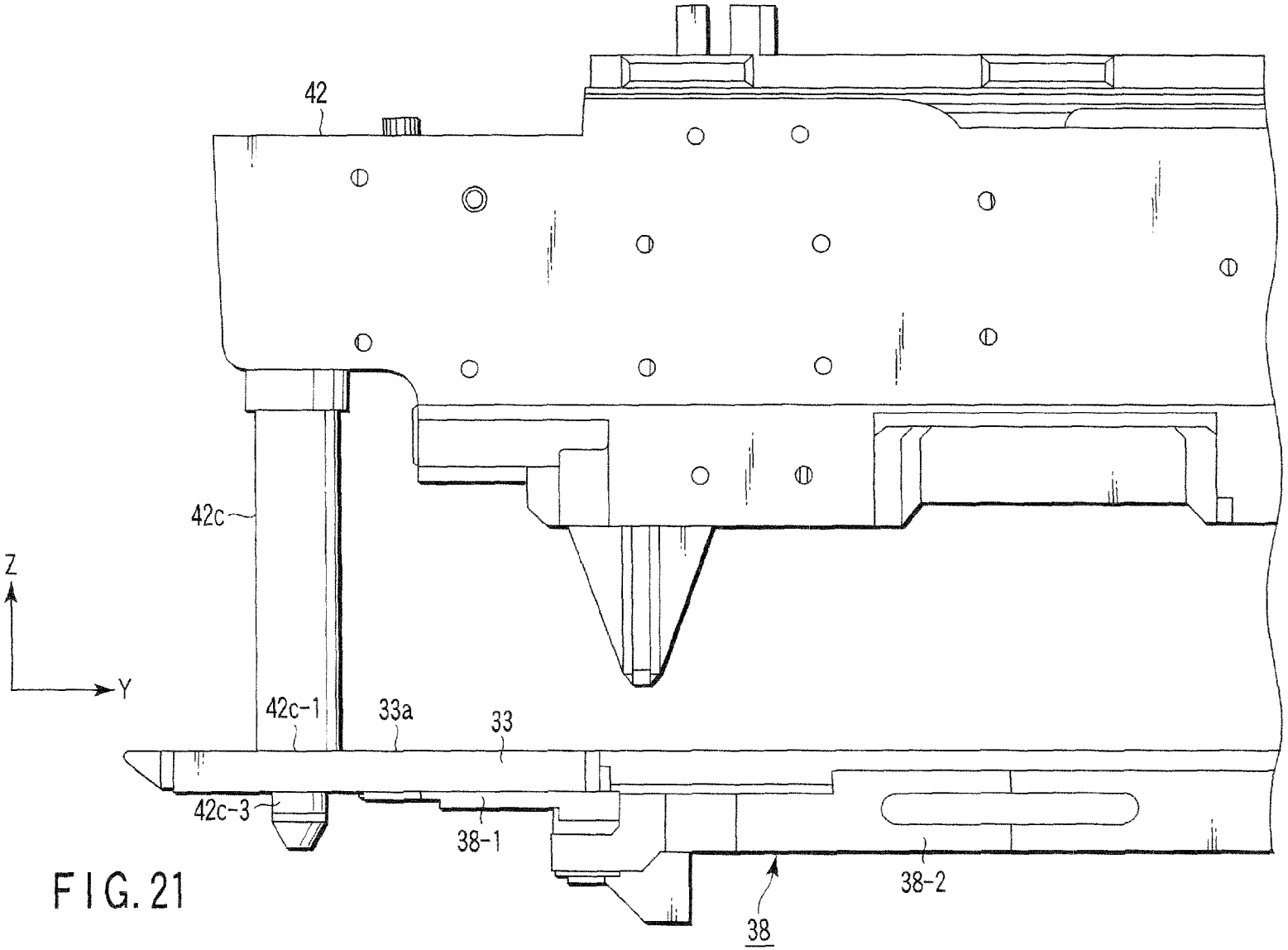
FIG. 21 is a diagram explaining an operation state of the carriage and the platen section in the first embodiment.

At this point, the spring 36*b*-6 of the platen driving unit 36 lifts the platen section 30 and the maintenance section 60 to ensure that they collide with the stepped surface 42*c*-1 of the pin 42*c* of the carriage 42. However, the force amount is set so that the carriage 42 is not lifted together with the maintenance section 60 and the platen section 30 via the platen section 30 and the pin 42*c*, and this ensures that the platen frame head facing surface 33*a* of the platen section 30 collides with the stepped surface 42*c*-1 of the pin 42*c* of the carriage 42, but the carriage 42 is not lifted. More specifically, the paper discharge side support portion 42*m* provided at the paper discharge side end of the carriage 42 does not rise from the support member provided in the apparatus frame 2 (state in FIG. 18B, see FIGS. 19 and 21). At this moment, a distance which enables the insertion of the slide hook 38-1 is secured in a space formed by a lower surface of the platen frame head facing surface 33*a* and a lower surface of the slit portion 42*c*-3 of the pin 42*c* of the carriage 42.

Figures 18A, 18B, 18C, 18D, 18E, 18F, 18G, 18H:
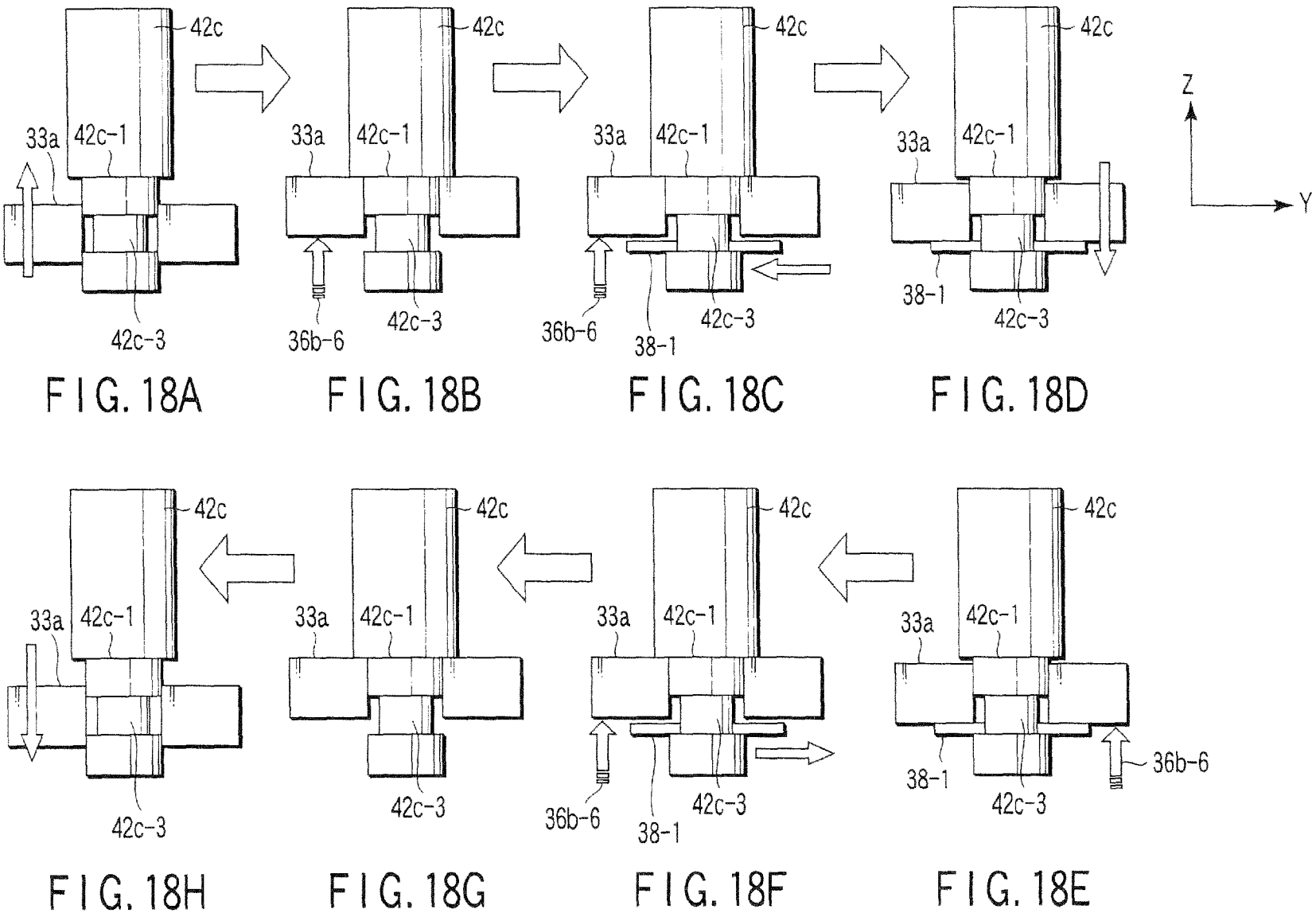
FIGS. 18A, 18B, 18C, 18D, 18E, 18F, 18G and 18H are diagrams explaining operation states of the pin in the first embodiment.
Figure 22:
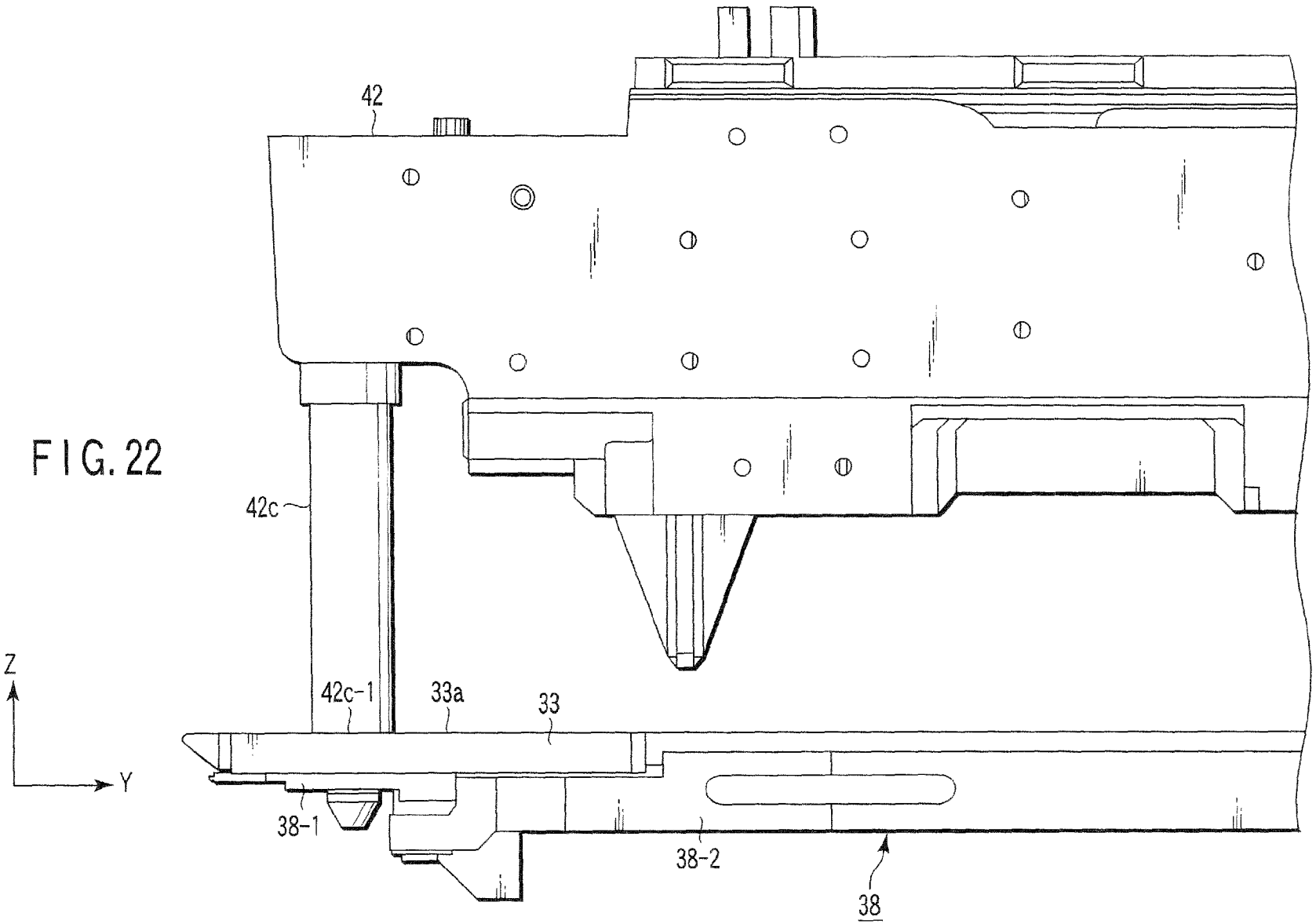
FIG. 22 is a diagram explaining an operation state of the carriage and the platen section in the first embodiment.

Next, from a state where the rack HPSW38-4 is turned on, the rack driving motor is rotated in a predetermined amount, and the rack member 38-2 is moved in an arrow direction, such that the slide hook 38-1 is moved to a predetermined print position (e.g., the plain paper position) (state in FIG. 18C, see FIG. 22).

When the movement of the rack member 38-2 is finished, the platen driving unit 36 is rotated and pivots from the upper dead point. At the beginning of the operation, the platen support portion 36*b* of the platen driving unit 36 is pushed down without being able to resist the weight of the carriage 42, the maintenance section 60 and the platen section 30. However, in accordance with the pivoting of the platen driving unit 36, the roller 36*b*-1 moves until it collides with the end of the long hole 36*b*-2 of the arm 36*b*-3. So far, the platen section 30 is in collision with the carriage 42. From now on, as the pivoting of the platen driving unit 36 proceeds, the platen section 30 starts descending in an arrow direction shown in FIG. 18D, and the lower surface of the platen frame head facing surface 33*a* of the platen section 30 contacts an upper surface of the slide hook 38-1, and moreover, a lower surface of the slide hook 38-1 contacts a lower surface of the slit portion 42*c*-3 of the pin 42 (refer to the state in FIG. 18D).

Figure 20:
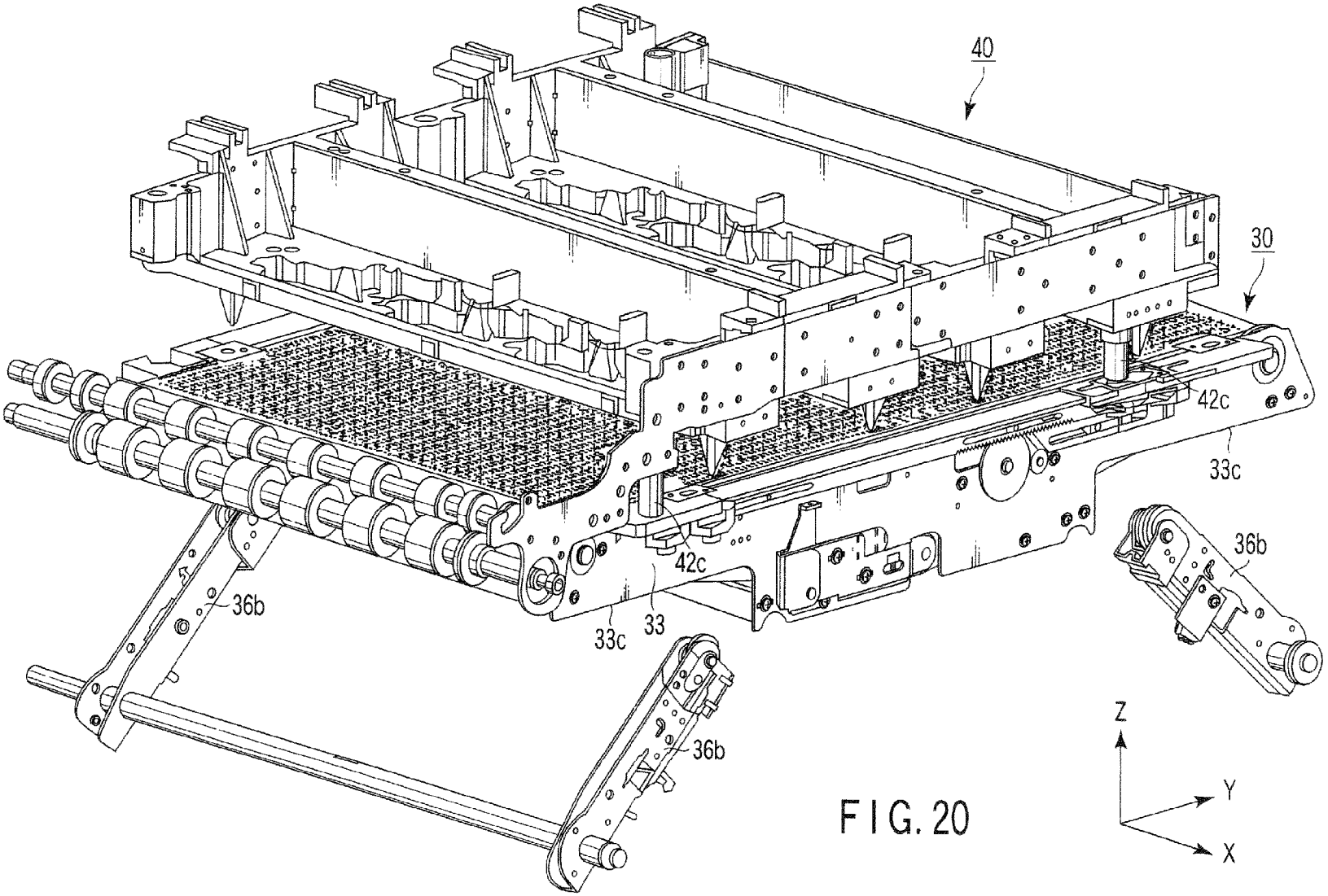
FIG. 20 is a diagram explaining an operation state of the carriage and the platen section in the first embodiment.

If the pivoting of the platen driving unit 36 further continues from here, the platen driving unit guide 33*c* of the platen section 30 is separated from the platen support portion 36*b* of the platen driving unit 36, and the platen section 30 becomes suspended from the carriage 42 via the pin 42*c* (see FIG. 20).

In this state, the platen section 30 is suspended by the carriage 42 supported by the apparatus frame 2, and is completely separated from the apparatus frame 2 without being directly supported by the apparatus frame 2. Thus, even if a disturbance and the like is applied to the apparatus frame 2 and the apparatus frame 2 is deformed, the positional relation between the platen section 30 and the carriage 42 does not change. Moreover, since the carriage 42 is held by the apparatus frame 2 via the paper feed roller coupling portions 42*d* and the registration roller pair 13, the positional relation among the registration roller pair 13, the platen section 30 and the carriage 42 does not change either. Therefore, there can be no change, in the X, Y and Z directions, of the positional relation between the recording paper conveyed by the registration roller pair 13 and the platen section 30, and the ink head lines 41 for the respective colors held by the carriage 42, and of the conveying direction.

After the completion of the evacuation of the maintenance section 60 and the completion of the disposal of the platen section 30 to a position where the recording medium can be conveyed, the pickup of the recording medium is started.

The control section 90 issues a driving instruction to the driving force transfer system, turns on the clutch, and rotationally drives the pickup roller 12. The pickup roller 12 picks up the recording medium from the recording medium tray 11, and conveys the recording medium to the registration roller pair 13 along the recording medium conveying direction. After the recording medium is picked up, the recording medium picked up is brought into line.

The control section 90 adjusts the placement of the recording medium during conveyance by the registration roller pair 13. More specifically, when the longitudinal direction of the recording medium is brought into coincidence with the recording medium conveying direction to convey the recording medium, an end at the tip of the recording medium extending in the width direction is pressed against the registration roller pair 13. During this pressing, the registration roller pair 13 is not driven. In addition, immediately before the pressing, the resist sensor 14*b* detects the recording medium. After the control section 90 has adjusted the position of the recording medium as described above, i.e., after a predetermined time has passed since the resist sensor 14*b* had detected the recording medium, the driving of the registration roller pair 13 is started. This causes the recording medium to be conveyed to an area of the image recording mechanism 20. Subsequently, a process of recording the image by the image recording mechanism 20 is performed.

In this image recording process, the control section 90 first issues a driving instruction to the platen chamber negative pressure generation source 34*a* of the platen section 30 before the recording medium is conveyed from the paper feed section 10. Thus, the first to third platen chambers 35*a*, 35*b* and 35*c* are brought under a negative pressure. In connection with this, the control section 90 issues a driving instruction to the belt roller driving motor 32*a*, and drives the platen belt 31. When the recording medium has been conveyed from the paper feed section 10 to the image recording mechanism 20 (at an initial point of conveyance), the tip of the recording medium is sucked and held to the platen belt 31 by the suction force of the first platen chamber 35*a*. Thus, the recording medium is prevented from rising from the platen belt 31. The sucked and held recording medium is moved by the platen belt 31 at a predetermined speed along the recording medium conveying direction. In this case, the two platen belt rollers 32 are kept substantially in parallel and support the platen belt 31 which conveys the recording medium so that it is parallel with the X and Y axes in the above-mentioned image recording state, that is, in the image recording state where the platen section 30 is suspended by the carriage 42.

Subsequently, when the tip of the recording medium has been conveyed to a position where it faces the ink head lines 41, the control section 90 issues an image recording instruction to the image recording section 40. Thus, each of the ink head lines 41 starts discharging the ink to the recording medium. The ejection of the ink is carried out for each of the ink head lines 41. Since the ink head lines 41 extend over the entire width of the recording medium, an image is recorded over the entire width in one ejection. Along with this image recording, the platen section 30 conveys the recording medium along the Y axis. Thus, the image is sequentially recorded in the longitudinal direction of the recording medium. Further, along with the above conveyance, the tip of the recording medium is conveyed to the position of the second platen chamber 35*b* on the Y axis. The suction force of the second platen chamber 35*b* is smaller than that of the first platen chamber 35*a* per unit area, but the installation area of the recording medium onto the platen belt 31 is greater than that at the initial point of conveyance, so that the recording medium is easily sucked and held.

Subsequently, when the tip of the recording medium has gone over the ink head line 41 closest to the discharge section 50 side on the Y axis, the tip of the recording medium is sucked and held by the third platen chamber 35*c*. It is to be noted that since the tip of the recording medium has passed all the ink head lines 41, the image recording has been completed. Then, all the areas of the recording medium pass all the ink head lines 41 to complete the overall image recording. It is to be noted that the recording medium is pinched by the discharge section conveying roller pair 51 of the discharge section 50 before all the areas thereof pass all the ink head lines 41 (e.g., even when the image is being recorded on the recording medium). The recording medium is subjected to the conveyance force of the discharge section conveying roller pair 51 when pinched by the discharge section conveying roller pair 51. However, the recording medium is sucked and held to the platen belt 31 by the suction force of the third platen chamber 35*c* (this suction force is greater than the suction force of the second platen chamber 35*b*). Therefore, the recording medium conveyed by the platen belt 31 can be conveyed at a constant speed by the platen belt 31 even when subjected to the conveyance force of the discharge section 50. The sticking force of the third platen chamber 35*c* applied to the recording medium can be maintained until the rear end of the recording medium being conveyed by the platen belt 31 passes all the ink head lines 41. In other words, the third platen chamber 35*c* provides a predetermined suction force to the recording medium so that the recording medium can be conveyed at a constant speed by the platen belt 31 until the whole recording medium passes the recording area. Then, when the rear end of the recording medium has passed the recording areas of all the ink heads, the image recording process is completed. The suction force acting on the position of the recording medium after the completion of the image recording process is smaller than the conveyance force of the discharge section conveying roller pair 51. More specifically, as the recording medium is conveyed along the conveying direction, the area sticking to the recording medium becomes smaller, and the force holding it stuck to the platen belt 31 therefore decreases. As a result, the suction force becomes smaller than the conveyance force of the discharge section 50, and the recording medium is discharged in accordance with the conveyance speed of the discharge section 50.

After a predetermined time has passed since the end of the image recording operation, or when a maintenance operation is started, it is necessary to move the platen section 30 from a recording operation position to a standby position or to a maintenance operation position.

First, the platen driving unit 36 is pivoted, and the platen section 30 suspended by the carriage 42 is again lifted in an arrow direction shown in FIG. 18E (refer to the state in FIG. 18E).

Figure 19:
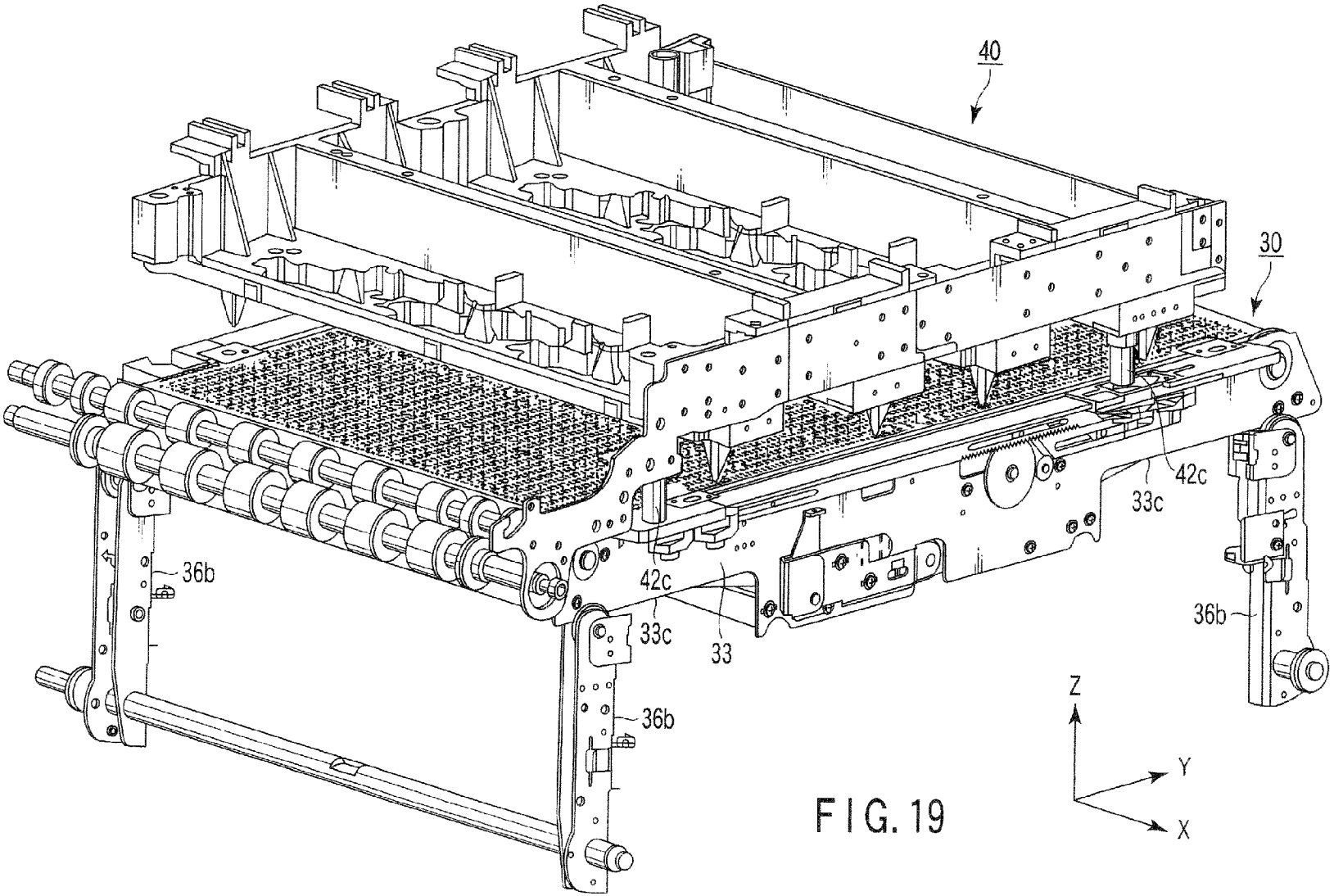
FIG. 19 is a diagram explaining an operation state of the carriage and the platen section in the first embodiment.

When the platen driving unit 36 is brought to the upper dead point, the platen section 30 again collides with the carriage 42, and a space sufficient to draw out the slide hook 38-1 in the arrow direction shown in FIG. 1F is formed in a space formed, by the lower surface of the platen frame head facing surface 33*a* and the lower surface of the slit portion 42*c*-3 of the pin 42*c* (FIG. 19, refer to the state in FIG. 18F).

Here, the rack driving motor is rotated, and the slide hook 38-1 is drawn out until the rack HPSW38-4 is turned on (FIG. 22, refer to the state in FIG. 18G).

After it has been checked that the racks HPSW38-4 are turned on both the front and rear sides, the platen driving unit 36 is pivoted the other way round from the upper dead point to lower the platen section 30 in an arrow direction shown in FIG. 18H (refer to the state in FIG. 18H).

It is to be noted that when either of on-outputs from the racks HPSW38-4 provided on the Front and rear sides cannot be obtained, that is, when the slide hook 38-1 remains undrawn, this fact can be reported to the control section 90 so that an abnormality in the image recording apparatus is announced on an unshown display section.

Furthermore, when a paper jam is caused, the platen section 30 can be separated from the image recording section 40 in a similar operation to secure a jam processing space.

Therefore, during the image recording, the platen section 30, which is recording medium conveying section, is held not by the apparatus frame 2 but by the carriage 42 of the image recording section 40 which is image recording section, so that the accuracy of positioning the image recording section 40 and the platen section 30 can be increased without being affected by, for example, the deformation of the apparatus frame 2, and it is possible to realize an image recording apparatus with high image quality in which the superposition of colors is always stable.

Next, a second embodiment of the present invention will be described.

The schematic configuration of an image recording apparatus according to the second embodiment is similar to that shown in the drawings for the first embodiment, and these drawings are therefore incorporated.

Figure 23A:
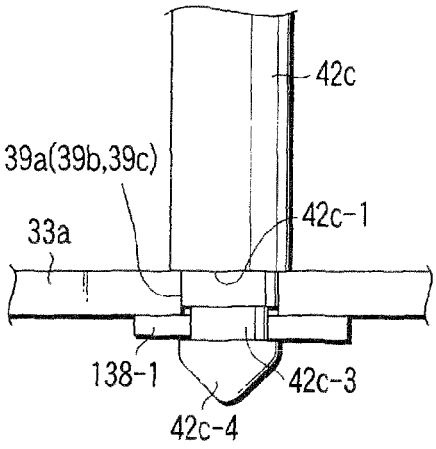
FIGS. 23A and 23B are diagrams showing the schematic configuration of essential parts in a second embodiment of the present invention.
Figure 23B:
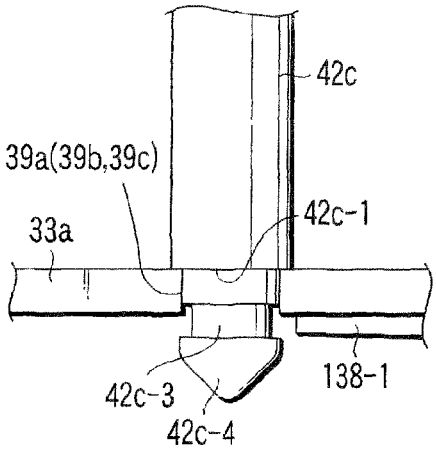

FIGS. 23A and 23B show the schematic configuration of essential parts in the second embodiment, wherein a wedge-shaped wedge slide 138-1 is inserted in the space formed between the lower surface of the slit portion 42*c*-3 of the pin 42*c* of the carriage 42 and the lower surface of the platen frame head facing surface 33*a* of the platen section 30 (the state in FIG. 23B). The rotation of the rack driving motor is utilized for the insertion of the wedge slide 138-1 in a manner similar to that described in the first embodiment. In this case, the inclination of a wedge surface of the wedge slide 138-1 is set to a small angle of 10 degrees or less, so that a high fastening force can be obtained even with a small insertion force.

This configuration is similar to that in the first embodiment in other respects.

According to the first embodiment, the bonding force (fastening force) between the platen section 30 and the image recording section 40 is determined by but does not become equal to or greater than the product of frictional resistance of the lower surface of the platen frame head facing a surface 33*a,* the pin 42*c* and the slide hook 38-1, and, normal force produced by the weight of the image recording section 40, the platen section 30 and the maintenance section 60. However, in the second embodiment, the wedge slide 138-1 is used instead of the slide hook 38-1, thereby making it possible to obtain the fastening force due to the driving of a wedge, in addition to the above fastening force and further ensuring the prevention of the movement of the platen section 30 with respect to the image recording section 40.

Next, a third embodiment of the present invention will be described.

In this case, the schematic configuration of an image recording apparatus according to the third embodiment is similar to that shown in the drawings for the first embodiment, and these drawings are therefore incorporated.

Figure 24:
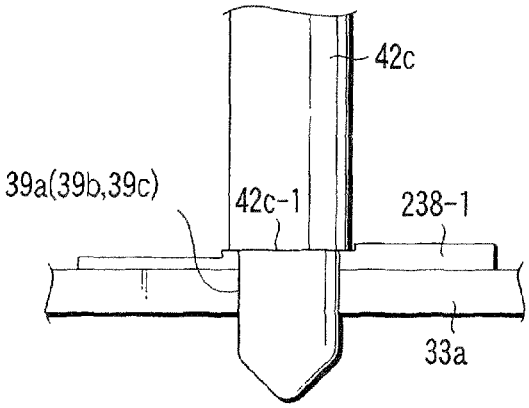
FIG. 24 is a diagram showing the schematic configuration of essential parts in a third embodiment of the present invention.

FIG. 24 shows the schematic configuration of essential parts in the third embodiment, wherein the pin 42*c* of the carriage 42 does not have the slit portions shown in the first embodiment, and the position of the stepped surface 42*c*-1 in the Z direction is located higher than that in the first embodiment. A slide hook 238-1 having portions of different thickness is disposed on an upper surface of the platen frame head facing surface 33*a* of the platen section 30. Moreover, as in the first embodiment, a released position and a plurality of engaging positions can be taken with respect to the pin 42*c* by the unshown rack driving motor.

The configuration is similar to that in the first embodiment in other respects.

In such a configuration, an operation of coupling the platen section 30 to the image recording section 40 will be explained.

First, in a state where the platen section 30 is located at the standby position, the unshown rack driving motor is rotated to move the slide hook 238-1 to a predetermined position in accordance with the thickness and type of the medium to record on. Then, the platen driving unit 36 is pivoted and brought to the upper dead point to cause the platen frame head facing surface 33*a* of the platen section 30 to collide with the stepped surface 42*c*-1 of the pin 42*c* of the carriage 42 via the slide hook 238-1.

In this state, a predetermined distance is secured between the ink head line 41 and the platen belt 31 in accordance with the thickness and type of the recording medium, and the platen section 30 is coupled to the image recording section 40, and then the recording operation is performed. When the platen section 30 is moved to, for example, the standby position, a maintenance position or a jam processing position, the platen driving unit 36 is pivoted in the opposite direction to lower the platen section 30 and move it to a predetermined height position (position in the Z direction).

This configuration is similar to that in the first embodiment in other respects.

Owing to such a configuration and operation, the platen section 30 is not completely separated from the apparatus frame 2, but the platen section 30 is elastically in contact with and held to the apparatus frame 2 via the platen support portion 36*b* of the platen driving unit 36. Thus, the platen support portion 36*b* can move with respect to the platen section 30 with a certain degree of freedom in the X, Y and Z directions. Therefore, a change in the position of the image recording section 40 and the platen section 30 due to the deformation of the apparatus frame 2 is negligible, and the superposition of colors is not impaired.

Next, a modification of a mechanism of coupling the carriage 42 and the platen section 30 will be explained by use of FIGS. 25A to 25D.

Figures 25A, 25B, 25C, 25D:
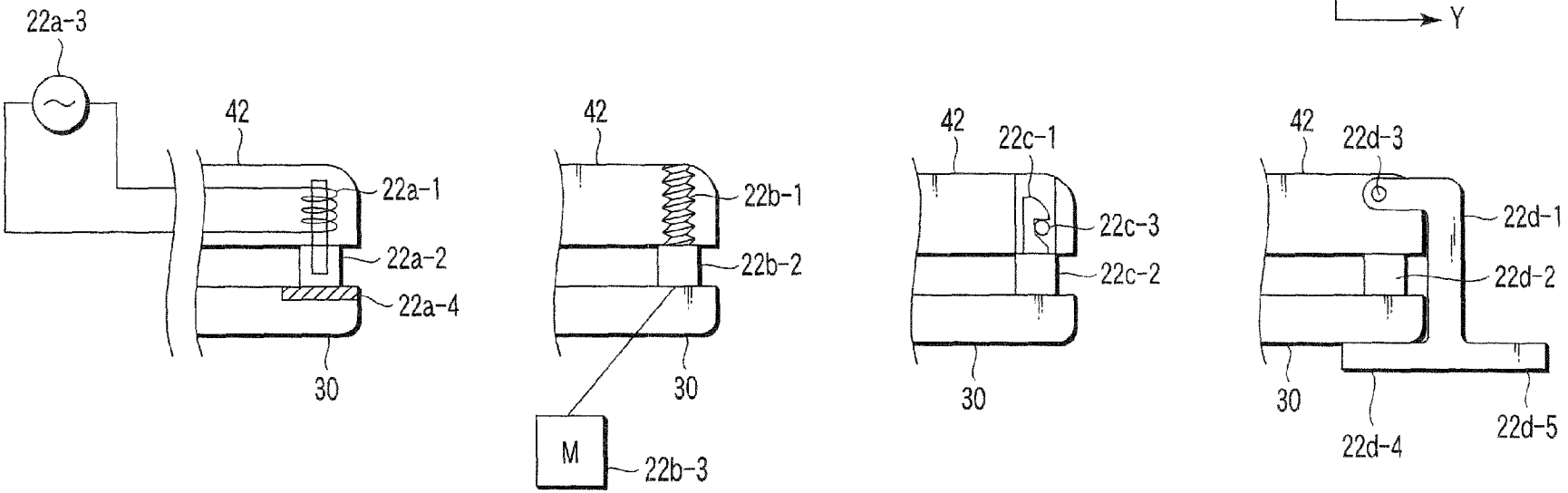
FIGS. 25A, 25B, 25C and 25D are diagrams showing the schematic configuration of a mechanism of coupling a carriage and a platen section in a modification of the present invention.

In this modification, an electromagnet 22*a*-1 is provided on the carriage 42 side, as shown in FIG. 25A. A power source 22*a*-3 is connected to the electromagnet 22*a*-1. The power source 22*a*-3 applies a voltage to the electromagnet 22*a*-1 in response to a command from the control section 90. Thus, the electromagnet 22*a*-1 can control the generation of magnetic force by turning on or off the power source 22*a*-3. Moreover, a stick plate 22*a*-4 is disposed for the electromagnet 22*a*-1 on the carriage 42 side via a positioning member 22*a*-2. This stick plate 22*a*-4 is provided on the platen section 30 side, and stuck and coupled via the positioning member 22*a*-2 by the magnetic force of the electromagnet 22*a*-1.

In such a configuration, the platen driving unit 36 is first pivoted so that the platen section 30 is lifted and contacts the carriage 42. After the contact, a voltage is applied from the power source 22*a*-3 in response to a command from the control section 90, and the electromagnet 22*a*-1 generates a magnetic force. The stick plate 22*a*-4 is stuck and thus coupled to the positioning member 22-*a*-2 by the magnetic force of the electromagnet 22*a*-1, and the platen section 30 is coupled to the carriage 42. Then, the platen driving unit 36 is pivoted in the opposite direction to separate the platen support portion 36*b* of the platen driving unit 36 from the platen section 30.

When the platen section 30 is separated from the carriage 42, the platen driving unit 36 is pivoted, and the application of the voltage from the power source 22*a*-3 is shut off in a state where the platen section 30 is placed on the carriage 42 by the platen support portion 36*b*. This eliminates the generation of the magnetic force of the electromagnet 22*a*-1 and cancels the coupling by sticking of the stick plate 22*a*-4 to the positioning member 22*a*-2, thereby separating the platen section 30 from the carriage 42.

In this manner, section for coupling the carriage 42 to the platen section 30 is basically formed by the electromagnet alone, so that complex mechanical members are not needed, and the coupling and separating operations are simplified, thus making it possible to realize a more reliable configuration.

Next, as shown in FIG. 25B, a female screw 22*b*-1 is provided on the carriage 42 side, and a male screw 22*b*-2 is provided on the platen section 30 side. Moreover, a screw motor 22*b*-3 is connected to the male screw 22*h*-2. This screw motor 22*b*-3 rotates the male screw 22*b*-2 forward or backward in accordance with a command from the control section 90.

In such a configuration, the platen driving unit 36 is pivoted so that the platen section 30 is lifted and the male screw 22*b*-2 provided on the platen section 30 side contacts the carriage 42. Then, the screw motor 22*b*-3 rotates forward in response to the command from the control section 90, and the male screw 22*b*-2 is screwed into the female screw 22*b*-1 provided on the carriage 42 side. This screwing operation causes the platen section 30 to be suspended from the carriage 42, and the platen section 30 is finally coupled to the carriage 42 by the fastening force of the screw.

At this point, since the platen section 30 approaches the carriage 42 by the screwing operation for the last several millimeters, there is no need for an operation of separating the platen support portion 36*b* of the platen driving unit 36 from the platen section 30 by the reverse pivoting of the platen driving unit 36.

When the carriage 42 is separated from the platen section 30, the screw motor 22*h*-3 reversely rotates in response to a command from the control section 90, and the male screw 22*b*-2 is pulled out of the female screw 23*b*-1 provided on the carriage 42 side. When the male screw 22*b*-2 is completely pulled out of the female screw 22*b*-1, the platen section 30 contacts the platen support portion 36*b* of the platen driving unit 36 located at the upper dead point. Then, the platen driving unit 36 is pivoted to lower the platen section 30.

Thus, the platen section 30 is coupled to the carriage 42 by the fastening force of the screw, such that a large fastening force can be obtained by a small screw torque, thereby making it possible to obtain an image recording apparatus in which there is no change in the position of the carriage 42 and the platen section 30.

Next, in FIG. 25C, a claw-shaped hook 22*c*-1 is provided on the platen section 30 side via a positioning member 22*c*-2. On the carriage 42 side, there is provided a lock pin 22*c*-3 capable of being unhooked from the hook 22*c*-1 by un unshown solenoid.

In such a configuration, the platen driving unit 36 is pivoted so that the platen section 30 is lifted and contacts the carriage 42. Owing to this contact, the hook 22*c*-1 is hooked to the lock pin 22*c*-3, and the platen section 30 is coupled to the carriage 42. Then, the platen driving unit 36 is pivoted in the opposite direction to separate the platen support portion 36*b* of the platen driving unit 36 from the platen section 30.

When the platen section 30 is separated from the carriage 42, the platen driving unit 36 is pivoted, and the unshown solenoid operates in response to a command from the control section 90 to evacuate the lock pin 22*c*-3 from the hook 22*c*-1 in a state where the platen section 30 is placed on the carriage 42 by the platen support portion 36*b*. In this state, since the carriage 42 is separated from the platen section 30, the platen driving unit 36 is reversely pivoted to lower the platen section 30.

Thus, when the carriage 42 is coupled to the platen section 30, no extra operation is needed, so that it is possible to reduce the time (fast print time) from the reception of a recording operation starting instruction to the actual start of the recording operation.

Next, in FIG. 25D, a manual lever 22*d*-1 having a hook 22*d*-4 and a handle 22*d*-5 is provided on the carriage 42 side rotatably on a rotation shaft 22*d*-3, so that the platen section 30 is coupled via a positioning member 22*d*-2 by a pivoting operation of the manual lever 22*d*-1.

In such a configuration, the platen driving unit 36 is pivoted so that the platen section 30 is lifted and contacts the carriage 42. In this state, if the manual lever 22*d*-1 in a released state is pivoted with the handle 22*d*-5 thereof, the hook 22*d*-4 is hooked to the lower surface of the platen section 30. This operation causes the carriage 42 to be coupled to the platen section 30. In this state, a command is given to the control section 90 in accordance with an operation from an unshown operation panel, and the platen driving unit 36 is pivoted in the opposite direction to separate the platen support portion 36*b* of the platen driving unit 36 from the platen section 30.

When the platen section 30 is separated from the carriage 42, a command is given to the control section 90 in accordance with an operation from the unshown operation panel, and the platen driving unit 36 is pivoted to reproduce the state where the platen section 30 is placed on the carriage 42 by the platen support portion 36*b*. In this state, the manual lever 22*d*-1 is pivoted in a direction opposite to the direction described above with the handle 22*d*-5 thereof, thereby detaching the hook 22*d*-4 from the lower surface of the platen section 30. Then, a command is given to the control section 90 in accordance with an operation from the unshown operation panel, and the platen driving unit 36 is reversely pivoted to lower the platen section 30

Thus, since the carriage 42 can be manually coupled to and separated from the platen section 30, driving members such as the solenoid and motor are not needed, thereby enabling the mechanism of coupling the carriage 42 and the platen section 30 to be inexpensively realized.

Next, a fourth embodiment of the present invention will be described.

In this case, the schematic configuration of an image recording apparatus according to the fourth embodiment is similar to that shown in the drawings for the first embodiment, and these drawings are therefore incorporated.

Figure 26A:
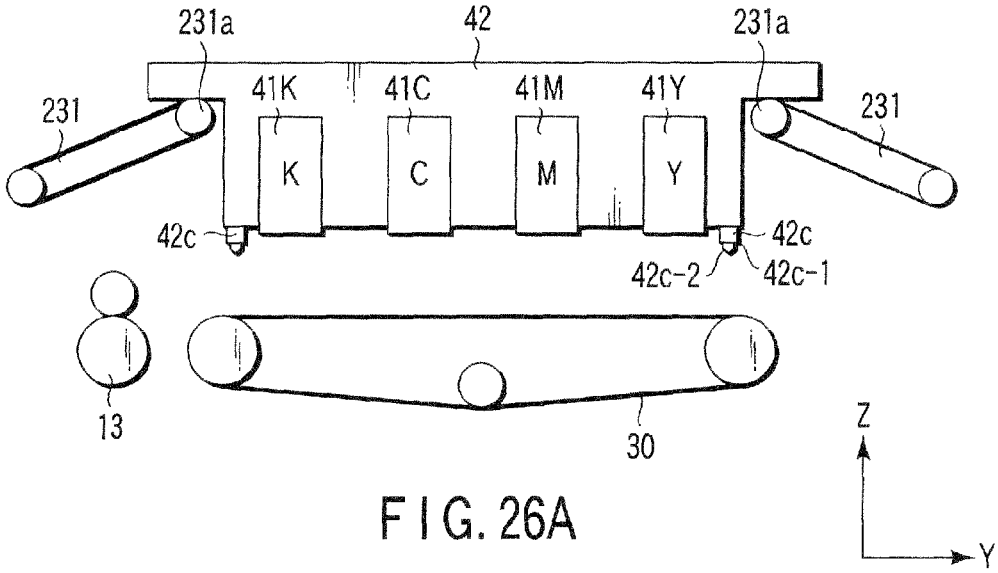
FIGS. 26A, 26B and 26C are diagrams showing the schematic configuration of essential parts in a fourth embodiment of the present invention.
Figure 26B:
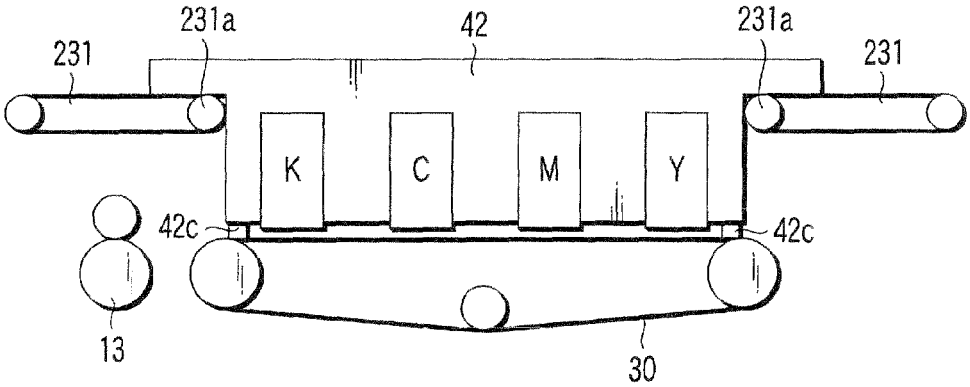
Figure 26C:
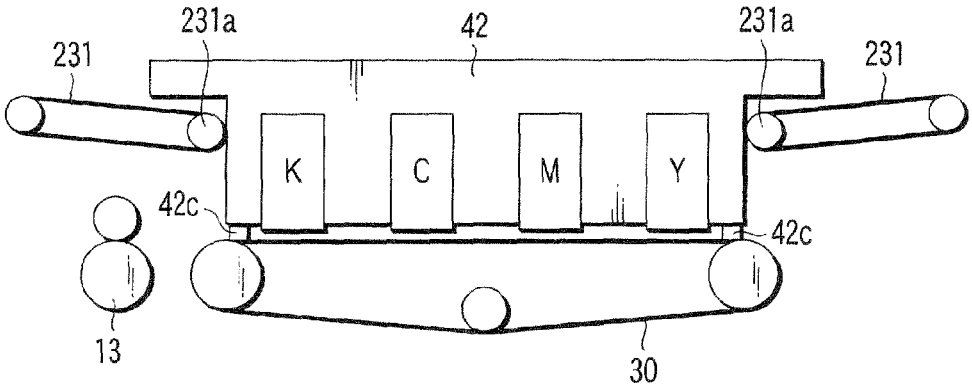

FIGS. 26A, 26B and 26C show the schematic configuration of essential parts in the fourth embodiment. The carriage 42 having the recording heads for four colors of K, C, M and Y is configured to be able to approach and separate from the platen section 30 supported on the apparatus frame 2 which holds the recording paper onto the belt and conveys the recording medium thereon. Two carriage drivers 231 are disposed at both ends of such a carriage 42. The carriage drivers 231 bring carriage support portions 231*a* into contact with the carriage 42 to raise or lower the carriage 42.

This configuration is similar to that in the first embodiment in other respects.

In such a configuration, during standby, the carriage support portions 231*a* of the carriage drivers 231 contact the carriage 42 to lift the carriage 42, and the carriage 42 is kept separate from the platen section 30. In this state, the carriage 42 is not directly supported by the apparatus frame 2 but supported by the apparatus frame 2 via the carriage drivers 231 (see FIG. 26A).

Next, when the recording operation is started, the carriage drivers 231 are pivoted, the carriage 42 descends toward the platen section 30, and the pin 42*c* is, in FIG. 26, fitted into and positioned by the unshown platen guide hole 39*a* (39*b*, 39*c*), and then the stepped surface 42*c*-1 of the pin 42*c* contacts the platen frame head facing surface 33*a* of the platen section 30 (see FIG. 26B).

Then, the carriage drivers 231 are further pivoted to separate the carriage support portions 231*a* of the carriage drivers 231 from the carriage 42 (see FIG. 23C).

In this state, the cylindrical surface 42*c*-2 of the pin 42*c* contacts the platen guide hole 39*a* (39*b*, 39*c*) to position the carriage 42 with respect to the platen section 30 in the X and Y directions. Further, the stepped surface 42*c*-1 of the pin 42*c* contacts the platen frame head facing surface 33*a* of the platen section 30 to position the carriage 42 in the Z direction. In addition, the carriage 42 is simply placed on the platen section 30 by its own weight, but since the weight of the carriage 42 is sufficiently heavy, the carriage 42 is coupled to the platen section 30 by its own weight.

Therefore, unless a force equal to or greater than the weight of the carriage 42 is applied, the carriage 42 does not move with respect to the platen section 30. When the carriage 42 is coupled thereto, the force applied to the carriage 42 comes solely from the platen section 30 because the carriage drivers 231 are separate from the carriage 42, so that the carriage 42 does not move with respect to the platen section 30.

Furthermore, since the coupling is basically achieved by the weight of the carriage 42 itself, no extra coupling mechanism is needed, and it is possible to realize an inexpensive and highly reliable coupling mechanism. At the same time, in this configuration, no extra components and operations are needed such as the slide hook 38-1 shown in the first embodiment when the carriage 42 is coupled to the platen section 30, such that it is possible to reduce the time (fast print time) from the reception of the recording operation starting instruction to the actual start of the recording operation.

Next, a fifth embodiment of the present invention will be described.

In this case, the schematic configuration of an image recording apparatus according to the fifth embodiment is equivalent to that shown in the first embodiment, and therefore, the components and reference numerals therein are used for explanation.

Figure 27A:
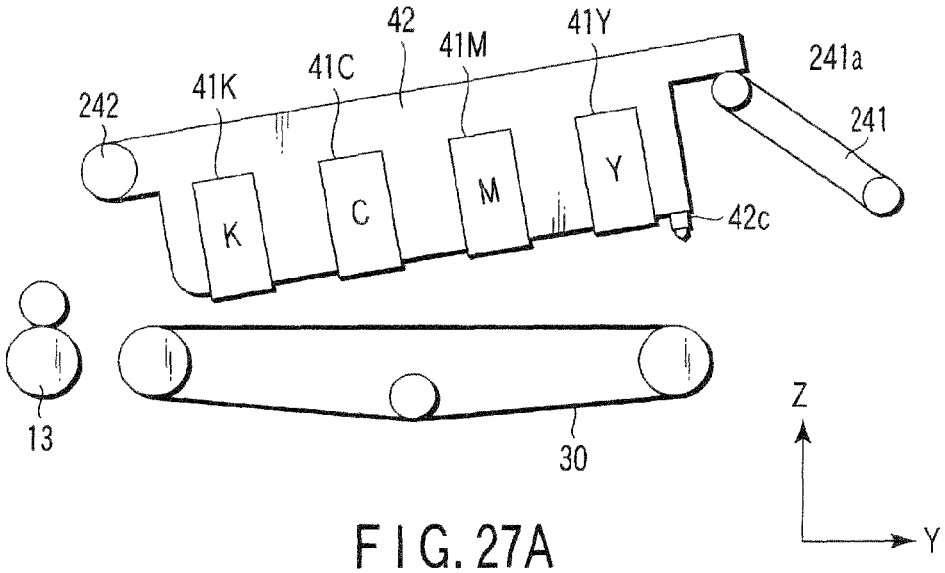
FIGS. 27A, 27B and 27C are diagrams showing the schematic configuration of essential parts in a fifth embodiment of the present invention.
Figure 27B:
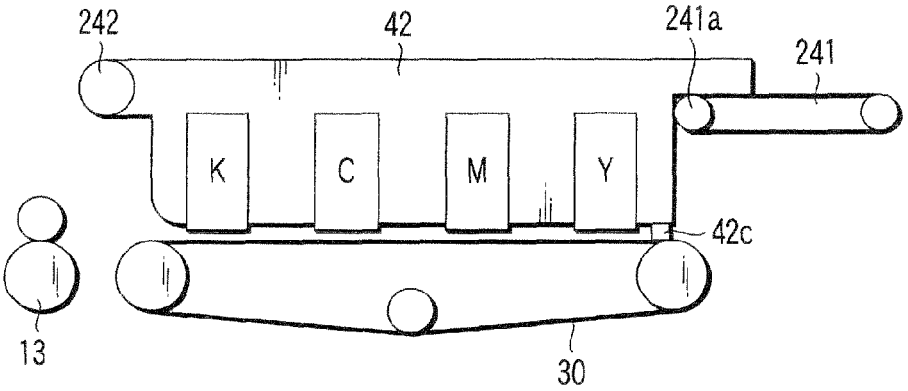
Figure 27C:
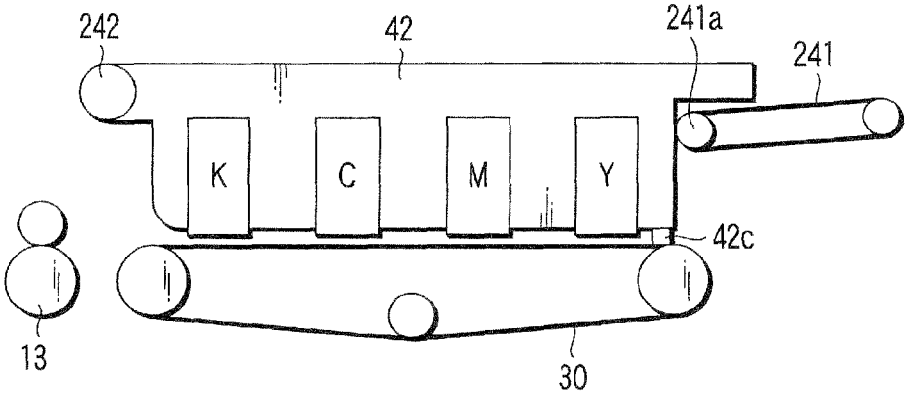

FIGS. 27A, 27B and 27C show the schematic configuration of essential parts in the fifth embodiment. The carriage 42 having the recording heads for four colors of K, C, M and Y is configured to be able to, pivotally on a pivot 242, approach and separate from the platen section 30 which holds the recording paper onto the belt and conveys the recording medium thereon. The pivot 242 is pivotally held to the apparatus frame 2. Two carriage drivers 241 are disposed at both ends of the carriage 42. The carriage drivers 241 can bring a carriage support portion 241*a* into contact with the carriage 42 to raise or lower the carriage 42.

The configuration is similar to that in the first embodiment in other respects.

In such a configuration, during standby, the carriage support portions 241*a* of the carriage drivers 241 contact the carriage 42 to lift the carriage 42, and the carriage 42 is kept separate from the platen section 30 (see FIG. 27A).

Next, when the recording operation is started, the carriage drivers 241 are pivoted, and the carriage 42 pivots and descends toward the platen section 30. The pin 42*c* is, in FIG. 24, fitted into and positioned by the unshown platen guide hole 39*a* (39*b*, 39*c*), and the stepped surface 42*c*-1 of the pin 42*c* contacts the platen frame head facing surface 33*a* of the platen section 30 (see FIG. 27B).

Then, the carriage drivers 241 are further pivoted to separate the carriage support portions 241*a* of the carriage drivers 241 from the carriage 42 (see FIG. 27C). In this state, the cylindrical surface 42*c*-2 of the pin 42*c* contacts the platen guide hole 39*a* (39*b*, 39*c*) to position the carriage 42 with respect to the platen section 30 in the X and Y directions. The stepped surface 42*c*-1 of the pin 42*c* contacts the platen frame head facing surface 33*a* of the platen section 30 to position the carriage 42 in the Z direction.

In addition, the carriage 42 is simply placed on the platen section 30 by its own weight, but since the weight of the carriage 42 is sufficiently heavy, the carriage 42 is coupled to the platen section 30 by its own weight.

Therefore, unless a force equal to or greater than the weight of the carriage 42 is applied, the carriage 42 does not move with respect to the platen section 30. When the carriage 42 is coupled thereto, the force applied to the carriage 42 comes solely from the platen section 30 because the carriage drivers 241 are separate from the carriage 42, so that the carriage 42 does not move with respect to the platen section 30.

Furthermore, since the coupling is basically achieved by the weight of the carriage 42 itself, no extra coupling mechanism is needed, and it is possible to realize an inexpensive and highly reliable coupling mechanism. At the same time, in this configuration, no extra operations are needed when the carriage 42 is coupled to the platen section 30, such that it is possible to reduce the time (fast print time) from the reception of the recording operation starting instruction to the actual start of the recording operation.

Still further, since an ascend/descend mechanism of the carriage 42 is a rotary mechanism which rotates on the pivot 242, there is no need for a link mechanism, slide mechanism or the like for parallel movement, thereby making it possible to realize an inexpensive and highly reliable coupling mechanism. The carriage 42 is held to the apparatus frame 2 via the pivot 242 even during the recording operation, but the carriage 42 is not, on the pivot 242 side, separated (raised/lowered) with respect to the platen section 30, so that displacement is not easily caused by the separating (raising/lowering) of the carriage 42.

Next, a sixth embodiment of the present invention will be described.

In this case, the schematic configuration of an image recording apparatus according to the sixth embodiment is equivalent to that shown in the first embodiment, and the same reference numerals are used for the same components for explanation.

Figure 28A:
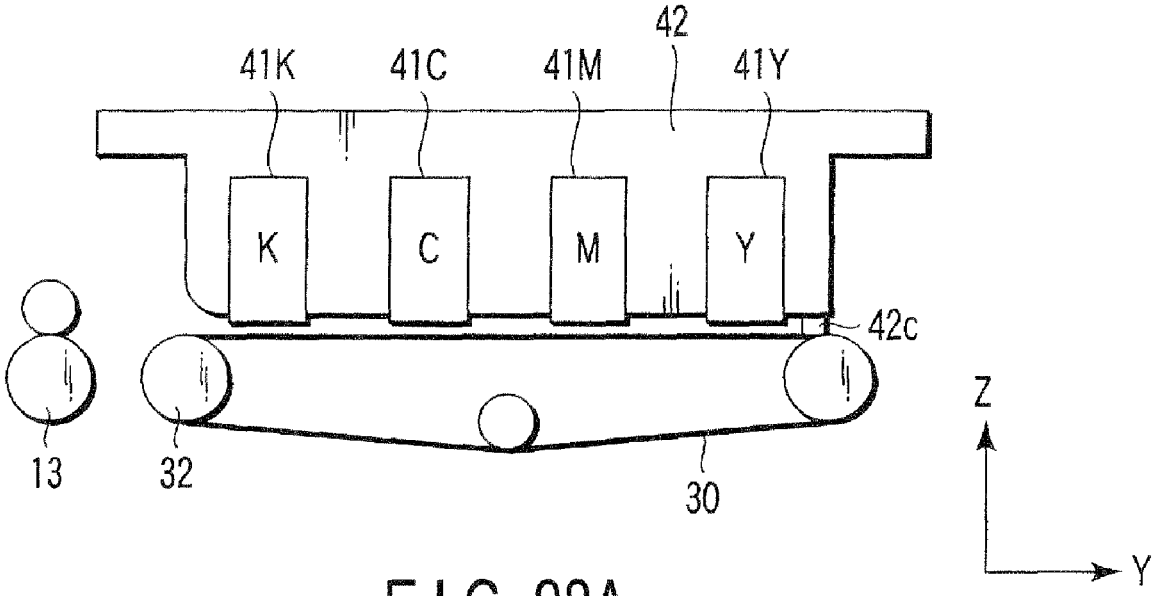
FIGS. 28A and 28B are diagrams showing the schematic configuration of essential parts in a sixth embodiment of the present invention.
Figure 28B:
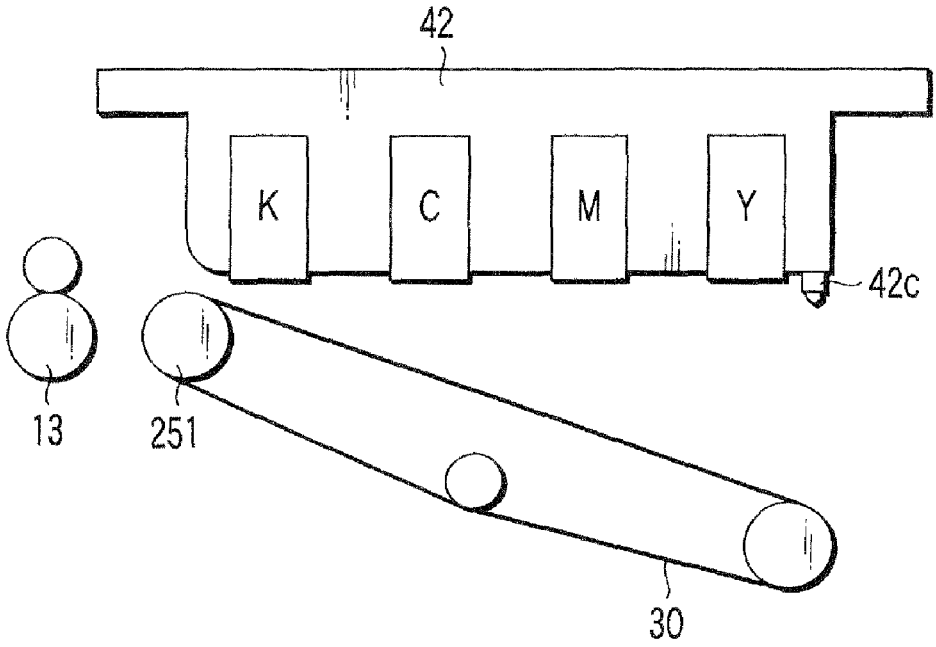

FIGS. 28A and 28B show the schematic configuration of essential parts in the sixth embodiment. Using the rotation shaft of one of the platen belt rollers 32 as a pivot 251, the platen section 30 pivots with respect to the carriage 42 having the recording heads for four colors of K, C, M and Y. The platen section 30 is configured so that it is pivoted in this manner to be able to approach and separate from the carriage 42. The pivot 251 is pivotally held to the apparatus frame 2.

The configuration is similar to that in the first embodiment in other respects.

In such a configuration, during standby, the platen section 30 is kept separate from the carriage 42 (see FIG. 28B).

Next, when the recording operation is started, the unshown platen driving unit 36 is pivoted in FIGS. 28A and 28B, such that the side of the lower platen section 30 opposite to the pivot 251 is lifted, and the platen section 30 is brought into contact with the carriage 42. In this state, the carriage 42 is coupled to the platen section 30 by, for example, the coupling mechanism as described with FIG. 25 (see FIG. 28A).

Then, the platen driving unit 36 is reversely pivoted to separate the platen support portion 36*b* of the platen driving unit 36 from the platen section 30.

Thus, since the ascend/descend mechanism of the platen section 30 is a rotary mechanism which rotates on the pivot 251, there is no need for a link mechanism, slide mechanism or the like for parallel movement, thereby making it possible to realize an inexpensive and highly reliable coupling mechanism. The platen section 30 is held to the apparatus frame 2 via the pivot 251 even during the recording operation, but the platen section 30 is not, on the pivot 251 side, separated (raised/lowered) with respect to the carriage 42, so that displacement is not easily caused by the separating (raising/lowering) of the platen section 30.

It is to be noted that the present invention is not limited to the embodiments described above, and various modifications can be made without changing the spirit thereof at the stage of implementation. For example, a space varying mechanism which is the platen driving unit 36 in the first embodiment described above is movable in all or one of the recording medium conveying direction, a direction perpendicular to the recording medium conveying direction, and a direction in which the platen section 30 faces the image recording section 40. Further, in at least the image recording state, at least one of the platen section 30 and the image recording section 40 may be configured to be brought into contact. Still further, engaging sections which are the pin 42*c* and the slide hook 38-1 in the first embodiment may be configured so that their positions are regulated in all or one of the recording medium conveying direction, the direction perpendicular to the recording medium conveying direction, and the direction in which the platen section 30 faces the image recording section 40, in accordance with the moving direction of the above-mentioned space varying mechanism.

Furthermore, the embodiments described above include inventions at various stages, and suitable combinations of a plurality of disclosed constitutional requirements permit various inventions to be extracted. For example, when the problems described in the section Description of the Related Art can be solved and the advantages described in the section BRIEF SUMMARY OF THE INVENTION can be obtained even if some of all the constitutional requirements shown in the embodiments are eliminated, a configuration in which those constitutional requirements are eliminated can be extracted as an invention.

According to the present invention, despite the deformation of the frame caused during the conveyance of the recording medium, it is possible to improve the accuracy of positioning the image recording section and the recording medium conveying section and to provide an image recording apparatus with high image quality in which the superposition of colors is always stable.

What is claimed is:

1. An image recording apparatus comprising:

a recording medium conveying section which conveys a recording medium;

an image recording section configured to record an image over an entire recording width of the recording medium;

a space varying section which is movable to be brought into contact with the recording medium conveying section, and which moves the recording medium conveying section to a record position where the image is recorded and a standby position different from the record position; and an engaging section which engages the recording medium conveying section with the image recording section in an image recording state in which the image is recorded by the image recording section, wherein the space varying section is not in contact with the recording medium conveying section in the image recording state.

2. The image recording apparatus according to claim 1, wherein the recording medium conveying section is held only by the image recording section via the engaging section in the image recording state.

3. The image recording apparatus according to claim 2, wherein the engaging section specifies a distance between the image recording section and the recording medium conveying section to a predetermined value in the image recording state.

4. The image recording apparatus according to claim 2, wherein:

the engaging section includes a first fit portion which is provided in one of the image recording section and the recording medium conveying section and which projects in a direction in which the image recording section faces the recording medium conveying section, and a second fit portion which is provided in the other of the image recording section and recording medium conveying section where the first fit portion is not provided and which is movable in a direction perpendicular to the direction in which the first fit portion projects; and the second fit portion is movable to fit to the first fit portion.

5. The image recording apparatus according to claim 4, wherein the first fit portion and the second fit portion fit to each other and thereby specify a distance between the image recording section and the recording medium conveying section to a predetermined value in the image recording state.

6. The image recording apparatus according to claim 5, wherein the first fit portion and the second fit portion fit in a plurality of different positions depending on an amount of movement of the second fit portion, and the distance between the image recording section and the recording medium conveying section is changeable.

7. The image recording apparatus according to claim 6, wherein the amount of movement of the second fit portion is determined by at least a thickness of the recording medium.

8. The image recording apparatus according to claim 1, wherein:

the image recording section and the recording medium conveying section are disposed opposite to each other;

the space varying section moves the recording medium conveying section up and down while the recording medium conveying section and the image recording section are opposite to each other; and the recording medium conveying section is suspended from the image recording section via the engaging section in the image recording state.

9. The image recording apparatus according to claim 8, wherein the engaging section specifies a distance between the image recording section and the recording medium conveying section to a predetermined value in the image recording state.

10. The image recording apparatus according to claim 8, wherein:

the engaging section includes a first fit portion which is provided in one of the image recording section and the recording medium conveying section and which projects in a direction in which the image recording section faces the recording medium conveying section, and a second fit portion which is provided in the other of the image recording section and the recording medium conveying section where the first fit portion is not provided and which is movable in a direction perpendicular to the direction in which the first fit portion projects; and the second fit portion is movable to fit to the first fit portion.

11. The image recording apparatus according to claim 10, wherein the first fit portion and the second fit portion are fit and thereby specify a distance between the image recording section and the recording medium conveying section to a predetermined value in the image recording state.

12. The image recording apparatus according to claim 11, wherein the first fit portion and the second fit portion fit in a plurality of different positions depending on an amount of movement of the second fit portion, and the distance between the image recording section and the recording medium conveying section is changeable.

13. The image recording apparatus according to claim 12, wherein the amount of movement of the second fit portion is determined by at least a thickness of the recording medium.

* * * * *